US009530373B2

(12) United States Patent
Ban et al.

(10) Patent No.: US 9,530,373 B2
(45) Date of Patent: Dec. 27, 2016

(54) METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: Samsung Display Co., LTD., Yongin, Gyeonggi-Do (KR)

(72) Inventors: Young-Il Ban, Hwaseong-si (KR); Sun-Koo Kang, Seoul (KR); Seung-Hwan Moon, Asan-si (KR); Sun-Kyu Son, Suwon-si (KR); Kyung-Ha Kim, Hwaseong-si (KR); Jae-Han Lee, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 21 days.

(21) Appl. No.: 14/286,769

(22) Filed: May 23, 2014

(65) Prior Publication Data

US 2014/0375703 A1 Dec. 25, 2014

(30) Foreign Application Priority Data

Jun. 25, 2013 (KR) ..... 10-2013-0072758
Oct. 31, 2013 (KR) ..... 10-2013-0131816

(51) Int. Cl.
*G09G 3/36* (2006.01)

(52) U.S. Cl.
CPC .... *G09G 3/3688* (2013.01); *G09G 2310/0248* (2013.01); *G09G 2330/023* (2013.01); *G09G 2360/16* (2013.01); *G09G 2370/08* (2013.01)

(58) Field of Classification Search
CPC ..... G09G 3/3688; G09G 3/3607
See application file for complete search history.

(56) References Cited

U.S. PATENT DOCUMENTS

| | | | | |
|---|---|---|---|---|
| 6,573,881 | B1 | 6/2003 | Kwon | |
| 7,746,336 | B2 | 6/2010 | Morita | |
| 8,089,437 | B2 | 1/2012 | Maekawa | |
| 8,199,095 | B2 | 6/2012 | Jung et al. | |
| 8,294,701 | B2 | 10/2012 | Matsui et al. | |
| 2009/0002302 | A1* | 1/2009 | Koo et al. | 345/89 |
| 2011/0012822 | A1 | 1/2011 | Park et al. | |
| 2011/0050677 | A1 | 3/2011 | Tsai et al. | |
| 2011/0057914 | A1 | 3/2011 | Nam | |
| 2012/0013591 | A1 | 1/2012 | Kim et al. | |
| 2012/0019502 | A1 | 1/2012 | Kawagoshi | |

(Continued)

FOREIGN PATENT DOCUMENTS

| | | |
|---|---|---|
| KR | 10-2006-0047139 | 5/2006 |
| KR | 10-2009-0060083 | 6/2009 |

(Continued)

*Primary Examiner* — Sahlu Okebato
(74) *Attorney, Agent, or Firm* — Innovation Counsel LLP

(57) ABSTRACT

A display panel driving apparatus includes an image pattern analyzing part, a clock signal generating part and a data driving part. The image pattern analyzing part is configured to analyze an image pattern of an image data. The clock signal generating part is configured to generating a clock signal having a different pulse width according to the image pattern of an image data. The data driving part is configured to drive a data line of a display panel in response to the clock signal. Thus, power consumption and heating of the data driving part may be decreased.

18 Claims, 18 Drawing Sheets

H-STRIPE PATTERN

WHITE PATTERN

(56) References Cited

U.S. PATENT DOCUMENTS

| | | | | |
|---|---|---|---|---|
| 2012/0043950 | A1* | 2/2012 | Truong et al. | 323/282 |
| 2012/0098813 | A1 | 4/2012 | Park et al. | |
| 2012/0133635 | A1 | 5/2012 | Ji et al. | |
| 2012/0162184 | A1 | 6/2012 | Kim et al. | |
| 2012/0218316 | A1* | 8/2012 | Wang et al. | 345/690 |

FOREIGN PATENT DOCUMENTS

| | | |
|---|---|---|
| KR | 10-2010-0076595 | 7/2010 |
| KR | 10-2012-0071848 | 7/2012 |
| KR | 10-2012-0074053 | 7/2012 |
| KR | 10-2012-0096777 | 8/2012 |

* cited by examiner

H-STRIPE PATTERN

WHITE PATTERN

METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

PRIORITY STATEMENT

This application claims priority under 35 U.S.C. §119 to Korean Patent Application No. 10-2013-0072758, filed on Jun. 25, 2013 and Korean Patent Application No. 10-2013-0131816, filed on Oct. 31, 2013 in the Korean Intellectual Property Office (KIPO), the contents of which are herein incorporated by reference in their entireties.

BACKGROUND OF THE INVENTION

1. Field of the Invention

Exemplary embodiments of the inventive concept relate to a method of driving a display panel, a display panel driving apparatus and a display apparatus having the display panel driving apparatus. More particularly, exemplary embodiments of the inventive concept relate to a method of driving a display panel used in a display apparatus, a display panel driving apparatus and a display apparatus having the display panel driving apparatus.

2. Description of the Related Art

A display apparatus such as a liquid crystal display apparatus includes a display panel, a data driving part and a gate driving part.

The display panel includes gate lines to which gate signals are applied, data lines to which data signals are applied and a plurality of pixels defined by the gate lines and the data lines, and displays an image.

Recently, a size of the display panel has been increased and a frequency of an image frame has been increased so as to improve display quality. Thus, power consumption and generation of heat of the data driving part driving the data lines in the display panel are increased.

SUMMARY OF THE INVENTION

Exemplary embodiments of the inventive concept provide a method of driving a display panel capable of decreasing power consumption and heating of a data driving part.

Exemplary embodiments of the inventive concept also provide a display panel driving apparatus performing the above-mentioned method.

Exemplary embodiment of the inventive concept also provides a display apparatus having the above-mentioned display panel driving apparatus.

According to an exemplary embodiment of the inventive concept, a method of driving a display panel includes analyzing an image pattern of an image data and generating a clock signal having a different pulse width according to the image pattern of an image data.

In one embodiment, the method may further include charging a pre-charge voltage to a data line in response to an activation of the clock signal.

In one embodiment, the pre-charge voltage may be charged to the data line during a first time period corresponding to a first pulse width when the clock signal has the first pulse width, and the pre-charge voltage may be charged to the data line during a second time period corresponding to a second pulse width when the clock signal has the second pulse width greater than the first pulse width.

In one embodiment, a first pre-charge voltage may be charged to the data line when the clock signal has a first pulse width, and a second pre-charge voltage greater than the first pre-charge voltage may be charged to the data line when the clock signal has a second pulse width greater than the first pulse width.

In one embodiment, the method may further include charging the data line with a target voltage in response to a deactivation of the clock signal.

In one embodiment, charging the pre-charge voltage to the data line may include charging the data line with the target voltage, sharing a current charged to a load capacitor of the display panel by the target voltage with a charge sharing capacitor to charge the charge sharing capacitor with an analog voltage and charging the data line with the pre-charge voltage using the analog voltage.

In one embodiment, the generating a clock signal having different pulse width may include generating a first pulse width of the clock signal when the image pattern is a black image or a white image and generating a second pulse width greater than the first pulse width of the clock signal when the image pattern is a stripe pattern of black alternating with white.

In one embodiment, the method may further include generating a slew rate control signal controlling a slew rate of a data signal applied to the data line.

In one embodiment, the slew rate may include a first slew rate when the image pattern is a black image or a white image and a second slew rate which is smaller than the first slew rate when the image pattern is a stripe pattern of a black alternating with a white.

According to another exemplary embodiment of the inventive concept, a display panel driving apparatus includes an image pattern analyzing part, a clock signal. The clock signal generating part is configured to generate a clock signal having a different pulse width according to the image pattern of an image data. The data driving part is configured to drive a data line of a display panel in response to the clock signal.

In one embodiment, the data driving part may charge a pre-charge voltage to the data line in response to an activation of the clock signal.

In one embodiment, the pre-charge voltage may be charged to the data line during a first time period corresponding to a first pulse width when the clock signal has the first pulse width, and the pre-charge voltage may be charged to the data line during a second time period corresponding to a second pulse width when the clock signal has the second pulse width greater than the first pulse width.

In one embodiment, the data driving part may charge the data line with a target voltage in response to a deactivation of the clock signal.

In one embodiment, the display panel driving apparatus may further include an analog voltage generating part configured to charge the data line with the pre-charge voltage, and a charge sharing part configured to charge the data line with the target voltage, the analog voltage generating part may include a charge sharing capacitor which shares a current charged to a load capacitor of the display panel, and the charge sharing part may include an amplifier which outputs the target voltage and a switch which selectively connects the amplifier and the charge sharing capacitor with the data line.

In one embodiment, the analog voltage generating part may include a first charge sharing capacitor selectively connected to a first data line of the data line and a second charge sharing capacitor selectively connected to a second data line of the data line, and the charge sharing part may include a first amplifier which outputs a first target voltage to the first data line, a second amplifier which outputs a second target voltage to the second data line, a first switch which selectively connects the first amplifier and the first charge sharing capacitor with the first data line and a second switch which selectively connects the second amplifier and the second charge sharing capacitor with the second data line.

In one embodiment, the analog voltage generating part may further include a third charge sharing capacitor connected to the first charge sharing capacitor and the second charge sharing capacitor, selectively connected to the first data line.

In one embodiment, the charge sharing capacitor may be selectively connected to a first data line of the data line.

In one embodiment, the clock signal generating part may generating a first pulse width of the clock signal when the image pattern is a black image or a white image and may generating a second pulse width of the clock signal greater than the first pulse width of the clock signal when the image pattern is a stripe pattern of black alternating with white.

In one embodiment, the image pattern analyzing part may further generating a slew rate control signal controlling a slew rate of a data signal applied to the data line.

According to still another exemplary embodiment of the inventive concept, a display apparatus includes a display panel and a display panel driving apparatus. The display panel is configured to receive a data signal based on an image data. The display panel driving apparatus includes an image pattern analyzing part configured to analyze an image pattern of an image data to output a clock control signal, a clock signal generating part configured to control a pulse width of a clock signal in response to the clock control signal to output the clock signal, and a data driving part configured to drive a data line of the display panel in response to the clock signal.

According to the inventive concept, an image pattern of an image data is analyzed, and a pulse width of a clock signal provided to a data driving part is controlled according to the image pattern. Therefore, a charge sharing time of a data line may be controlled adaptively to the image pattern, a data signal may be charged to the data line adaptively to the image pattern, and thus power consumption and generation of heat of the data driving part may be decreased.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
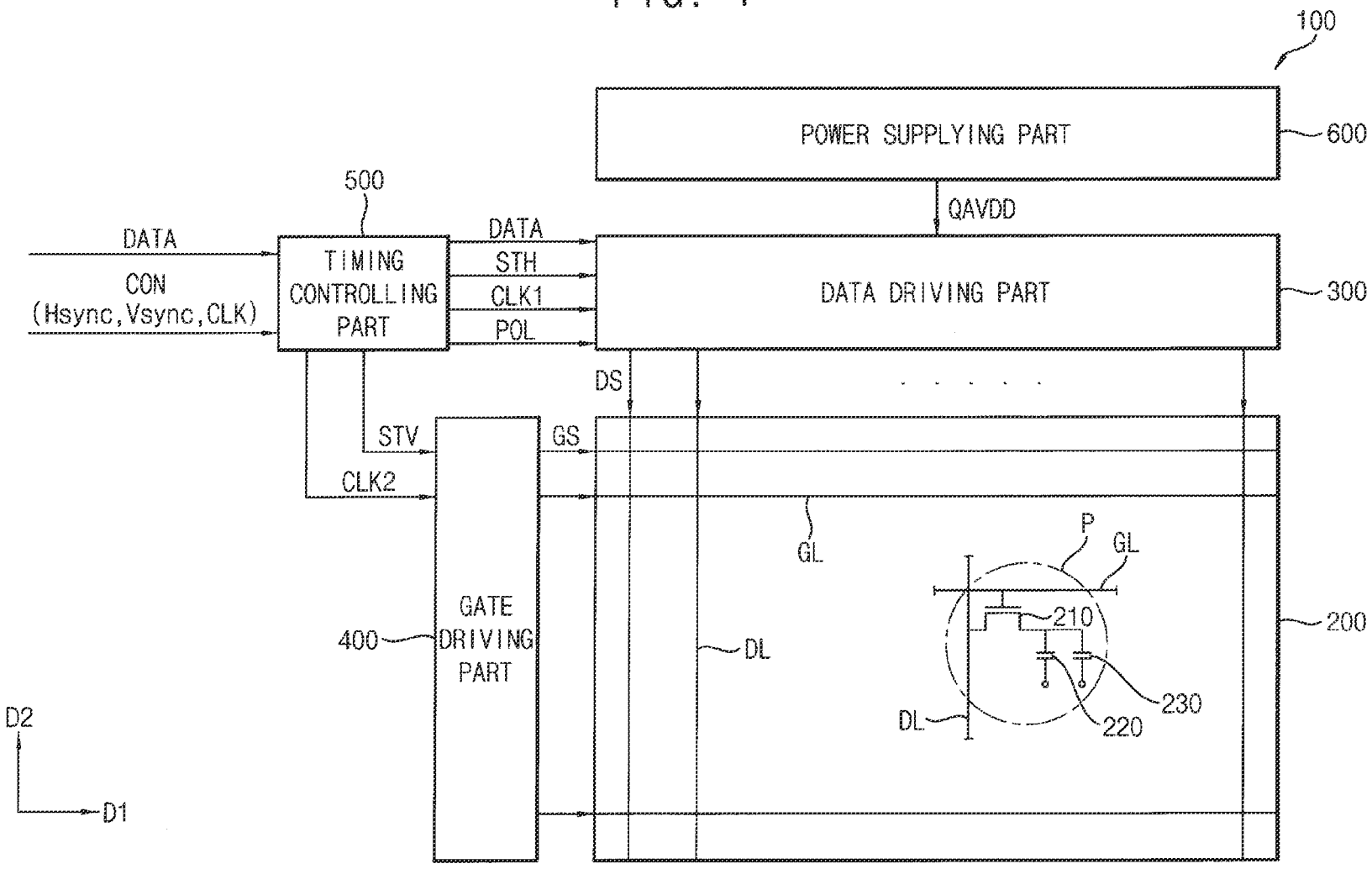
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus 100 according to the present exemplary embodiment includes a display panel 200, a data driving part 300, a gate driving part 400, a timing controlling part 500 and a voltage generating part 600. The data driving part 300, the gate driving part 400 and the timing controlling part 500 may be a display panel driving apparatus driving the display panel 200.

The display penal 200 receives a data signal DS based on an image data DATA to display an image. For example, the image data DATA may be two-dimensional image data. Alternatively, the image data DATA may include a left-eye image data and a right-eye image data for displaying a three-dimensional stereoscopic image.

The display panel 200 includes gate lines GL, data lines DL and a plurality of pixels P. The gate line GL extends in a first direction D1 and the data line DL extends in a second direction D2 substantially perpendicular to the first direction D1. The first direction D1 may be parallel with a long side of the display panel 200 and the second direction D2 may be parallel with a short side of the display panel 200. Each of the pixels P includes a thin film transistor 210 electrically connected to the gate line GL and the data line DL, a liquid crystal capacitor 220 and a storage capacitor 230 connected to the thin film transistor 210.

The data driving part 300 outputs the data signal DS based on the image data DATA to the data line DL, in response to a data start signal STH and a first clock signal CLK1 provided from the timing controlling part 500.

The gate driving part 400 generates a gate signal GS in response to a gate start signal STV and a second clock signal CLK2 provided from the timing controlling part 500, and outputs the gate signal GS to the gate line GL.

The timing controlling part 500 receives the image data DATA and a control signal CON from an outside. The control signal CON may include a horizontal synchronous signal Hsync, a vertical synchronous signal Vsync and a clock signal CLK. The timing controlling part 500 generates the data start signal STH using the horizontal synchronous signal Hsync and outputs the data start signal STH to the data driving part 300. In addition, the timing controlling part 500 generates the gate start signal STV using the vertical synchronous signal Vsync and outputs the gate start signal STV to the gate driving part 400. In addition, the timing controlling part 500 generates the first clock signal CLK1 and the second clock signal CLK2 using the clock signal CLK, outputs the first clock signal CLK1 to the data driving part 300 and outputs the second clock signal CLK2 to the gate driving part 400. In addition, the timing controlling part 500 may further output a polarity control signal POL controlling a polarity of the data signal DS outputted from the data driving part 300.

In addition, the timing controlling part 500 analyzes an image pattern of the image data DATA, and controls a pulse width of the first clock signal CLK1 outputted to the data driving part 300, based on the image pattern.

Specifically, the timing controlling part 500 decreases the pulse width of the first clock signal CLK1 when the image pattern is a white image. The timing controlling part 500 decreases the pulse width of the first clock signal CLK1 when the image pattern is a black image. The timing controlling part 500 increases the pulse width of the first clock signal CLK1 when the image pattern is a horizontal stripe or a vertical stripe of black alternating with white.

The voltage supplying part 600 provides an analog voltage QAVDD to the data driving part 300. The voltage supplying part 600 may generate a gate on voltage, a gate off voltage and a common voltage to provide the gate on voltage and the gate off voltage to the gate driving part 400 and provide the common voltage to the display panel 200.

Figure 2:
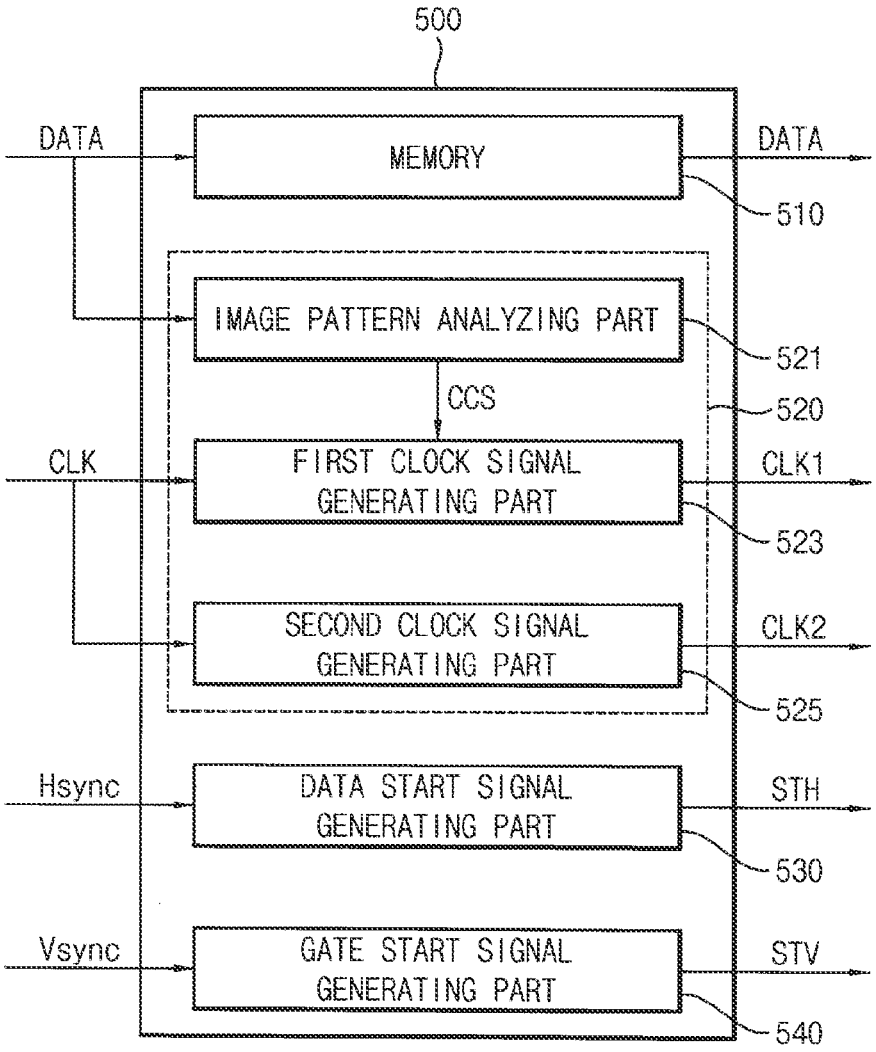
FIG. 2 is a block diagram illustrating a timing controlling part of FIG. 1.

FIG. 2 is a block diagram illustrating the timing controlling part 500 of FIG. 1.

Referring to FIGS. 1 and 2, the timing controlling part 500 includes a memory 510, a clock signal generating part 520, a data start signal generating part 530 and a gate start signal generating part 540.

The memory 510 receives the image data DATA applied from the outside of a display panel and outputs the image data DATA to the data driving part 300.

The clock signal generating part 520 includes an image pattern analyzing part 521, a first clock signal generating part 523 and a second clock signal generating part.

The image pattern analyzing part 521 receives the image data DATA and analyzes the image pattern of the image data DATA to generate a clock control signal CCS controlling the pulse width of the first clock signal CLK1 according to the image pattern. For example, the image pattern may include at least one of the horizontal stripe pattern, the sub vertical stripe pattern, a vertical stripe pattern, a black pattern and a white pattern.

The first clock signal generating part 523 generates the first clock signal CLK1 (a data clock signal) using the clock signal CLK received from the outside and outputs the data clock signal CLK1 to the data driving part 300. The first clock signal generating part 523 controls the pulse width of the first clock signal CLK1 according to the clock control signal CCS provided from the image pattern analyzing part 521.

The second clock signal generating part 525 generates the second clock signal CLK2 (a gate clock signal) using the clock signal received from the outside of the display panel and outputs the gate clock signal CLK2 to the gate driving part 400.

The data start signal generating part 530 generates the data start signal STH using the horizontal synchronous signal Hsync applied from the outside of the display panel and outputs the data start signal STH to the data driving part 300.

The gate start signal generating part 540 generates the gate start signal STV using the vertical synchronous signal Vsync applied from the outside of the display panel and outputs the gate start signal STV to the gate driving part 400.

Figure 3:
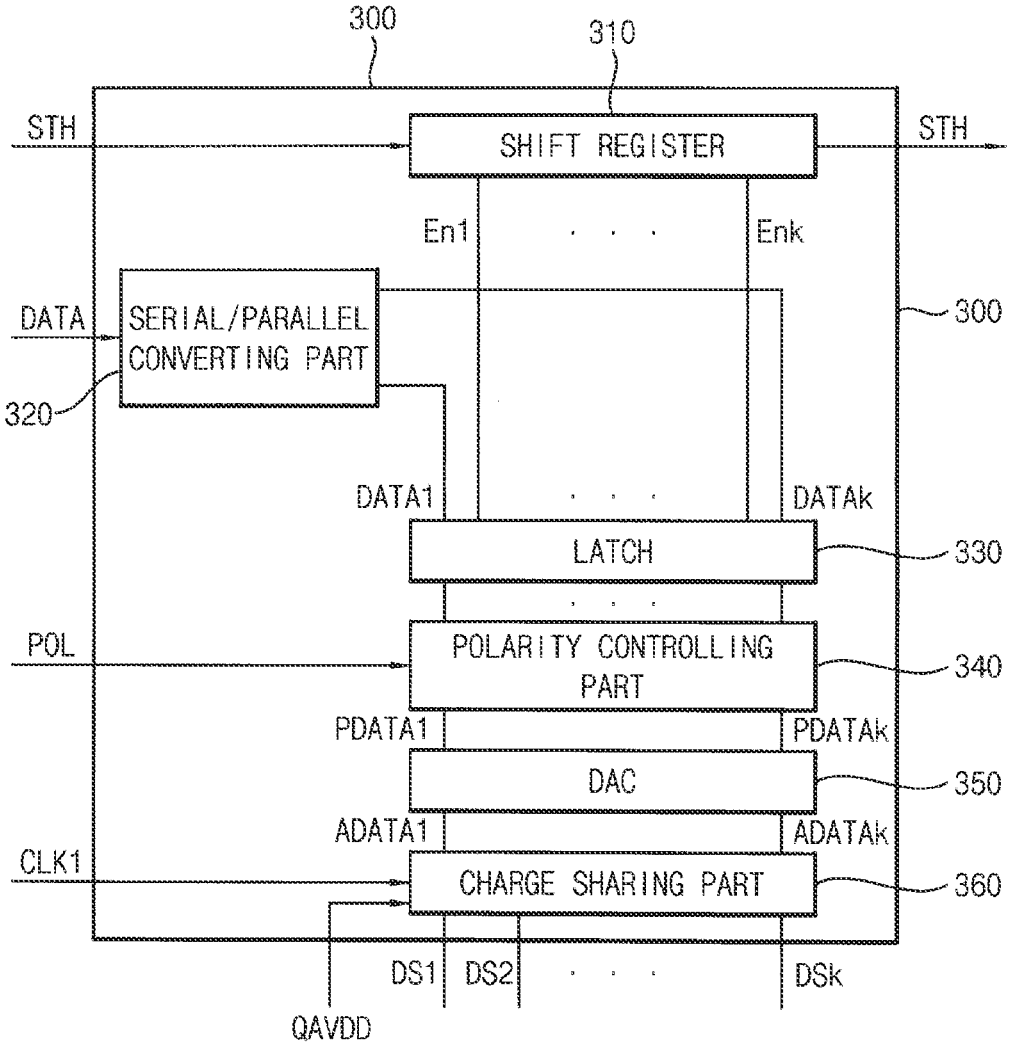
FIG. 3 is a block diagram illustrating a data driving part of FIG. 1.

FIG. 3 is a block diagram illustrating the data driving part 300 of FIG. 1.

Referring to FIGS. 1 to 3, the data driving part 300 includes a shift register 310, a serial/parallel converting part 320, a latch 330, a polarity controlling part 340, a digital-analog converting part DAC 350 and a charge sharing part 360.

The serial/parallel converting part 320 receives the serial image data DATA and converts the serial image data DATA into parallel image data DATA1, . . . , DATAk.

The shift register 310 shifts the data start signal STH and sequentially provides the parallel data DATA1, . . . , DATAk to the latch 330. Specifically, the shift register 310 sequentially outputs from a first enable signal En1 to a k-th enable signal Enk to sequentially stores the parallel data DATA1, . . . , DATAk to the latch 330. The latch 330 outputs the parallel data DATA1, . . . , DATAk to the polarity controlling part 340.

The polarity controlling part 340 controls polarities of the parallel data DATA1, . . . , DATAk based on the polarity control signal POL provided from the timing controlling part 500 to generate polarity data PDATA1, . . . , PDATAk, and outputs the polarity data PDATA1, . . . , PDATAk to the digital-analog converting part 350.

The digital analog converting part 350 converts the polarity data PDATA1, . . . , PDATAk received from the polarity controlling part 340 to analog data ADATA1, . . . , ADATAk and output the analog data ADATA1, . . . , ADATAk to the charge sharing part 360.

The charge sharing part 360 applies data signals DS1, DS2, . . . , DSk to the data lines DL using the analog data ADATA1, . . . , ADATAk according to the first clock signal CLK1 provided from the timing controlling part 500.

Figure 4:
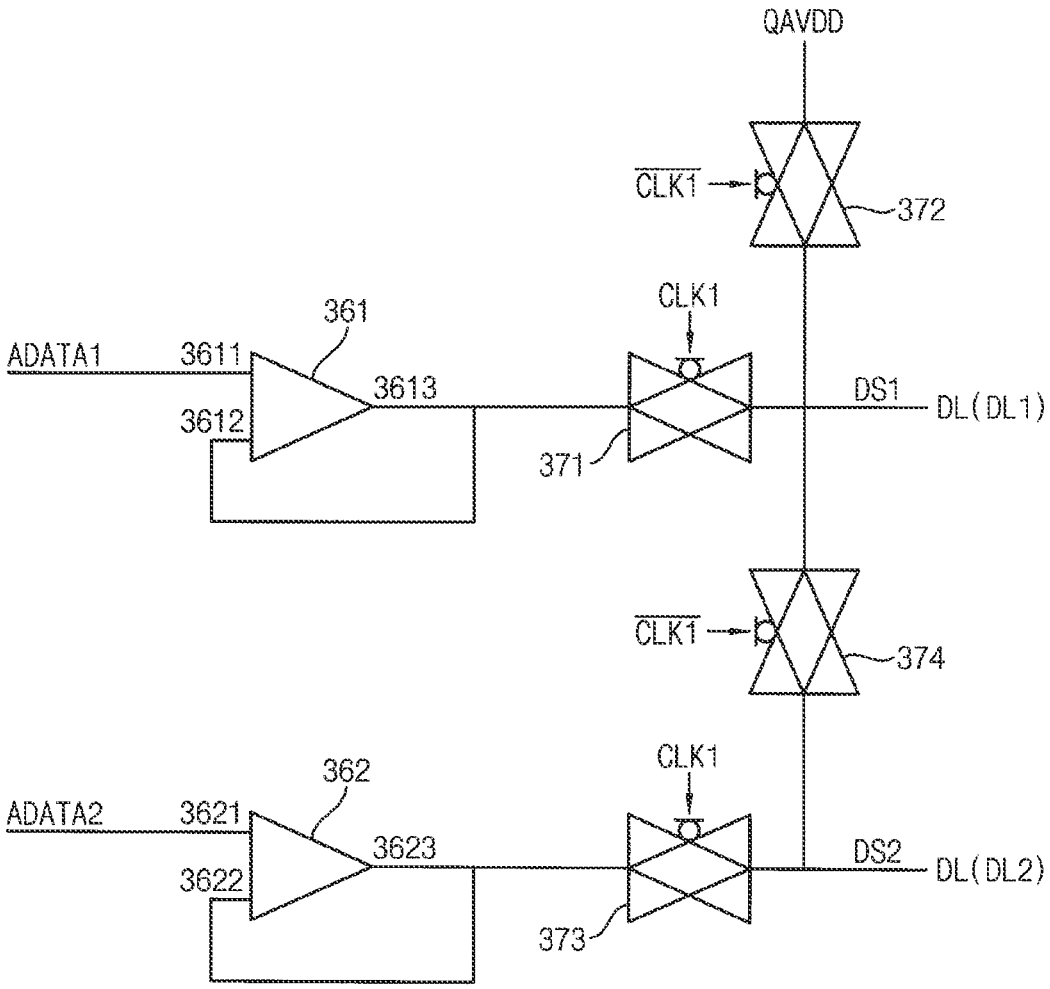
FIG. 4 is a block diagram illustrating a charge sharing part of FIG. 3.

FIG. 4 is a block diagram illustrating the charge sharing part 360 of FIG. 3.

Referring to FIGS. 1 to 4, the charge sharing part 360 includes a first amplifier 361, a second amplifier 362, a first switch 371, a second switch 372, a third switch 373 and a fourth switch 374.

The first amplifier 361 includes a first input terminal 3611, a second input terminal 3612 and an output terminal 3613. The first input terminal 3611 of the first amplifier 361 receives a first analog data ADATA1 outputted from the digital-analog converting part 350. The second input terminal 3612 of the first amplifier 361 selectively receives the analog voltage QAVDD through the second switch 372. The output terminal 3613 of the first amplifier 361 is connected to the second input terminal 3612 and is connected to the data line DL1 of the display panel 200 through the first switch 371.

The second amplifier 362 includes a first input terminal 3621, a second input terminal 3622 and an output terminal 3623. The first input terminal 3621 of the second amplifier 362 receives a second analog data ADATA2 outputted from the digital-analog converting part 350. The second input terminal 3622 of the second amplifier 362 selectively receives the analog voltage QAVDD through the fourth switch 374. The output terminal 3623 of the second amplifier 362 is connected to the second input terminal 3622 and is connected to the data line DL of the display panel 200 through the third switch 373.

The first switch 371 electrically connects the output terminal 3613 of the first amplifier 361 and the data line DL of the display panel 200 in response to a deactivation of the first clock signal CLK1. The data line DL electrically connected to the first amplifier 361 through the first switch 371 may be a first data line DL1.

The second switch 372 electrically connects the output terminal 3613 of the first amplifier 361 to the analog voltage QAVDD and the first data line DL1 of the display panel 200.

The third switch 373 electrically connects the output terminal 3623 of the second amplifier 362 and the data line DL of the display panel 200 in response to the deactivation of the first clock signal CLK1. The data line DL electrically connected to the second amplifier 362 through the third switch 373 may be a second data line DL2.

The fourth switch 374 electrically connects the output terminal 3623 of the second amplifier 362 to the analog voltage QAVDD and the second data line DL2 of the display panel 200.

Figure 5:
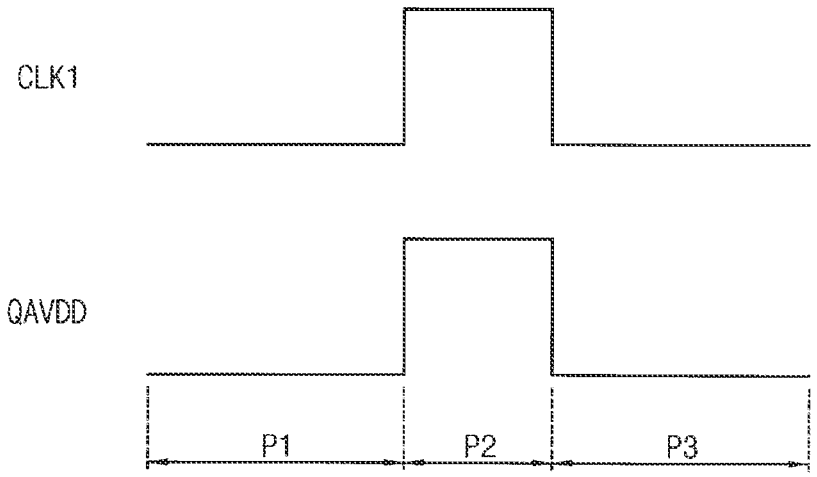
FIG. 5 is a timing diagram illustrating a first clock signal and an analog voltage of FIG. 4.

FIG. 5 is a timing diagram illustrating the first clock signal CLK1 and the analog voltage QAVDD of FIG. 4.

Referring to FIGS. 1 to 5, the first switch 371 and the third switch 373 are turned on and the second switch 372 and the fourth switch 374 are turned off during a first period P1 before the first clock signal CLK1 is activated. The first switch 371 and the third switch 373 are turned off and the second switch 372 and the fourth switch 374 are turned on in response to an activation of the first clock signal CLK1 during a second period P2 following the first period P1. Thus, the data lines DL are electrically connected with each other, the data line DL is pre-charged by the analog voltage QAVDD. The first switch 371 and the third switch 373 are turned on and the second switch 372 and the fourth switch 374 are turned off in response to the deactivation of the first clock signal CLK1 during a third period P3 following the second period P2. Thus, the target voltages are applied to the data lines DL by the first amplifier 361 and the second amplifier 362.

A first data signal DS1 may be applied to the first data line DL1 of the data lines DL, and a second data signal DS2 may be applied to the second data line DL2 of the data lines DL. In this case, a polarity of the first data signal DS1 and a polarity of the second data signal DS2 may be different from each other due to the polarity control signal POL provided from the timing controlling part 500 to the data driving part 300. For example, the polarity of the first data signal DS1 may be a positive polarity and the polarity of the second data signal DS2 may be a negative polarity. In addition, polarities of odd-numbered data signals applied to odd-numbered data lines may be the positive polarities and polarities of even-numbered data signals applied to even-numbered data lines may be the negative polarities. Alternatively, the polarities of the odd-numbered data signals applied to the odd-numbered data lines may be the negative polarities and the polarities of the even-numbered data signals applied to the even-numbered data lines may be the positive polarities.

Figure 6A:
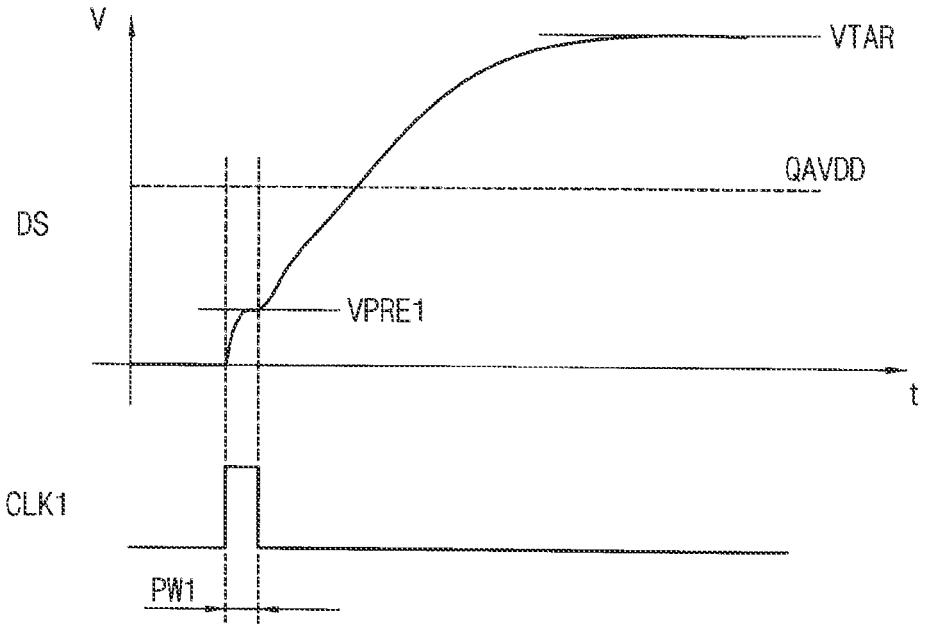
FIGS. 6A and 6B are timing diagrams illustrating a data signal applied to a data line according to a pulse width of the first clock signal of FIG. 1.
Figure 6B:
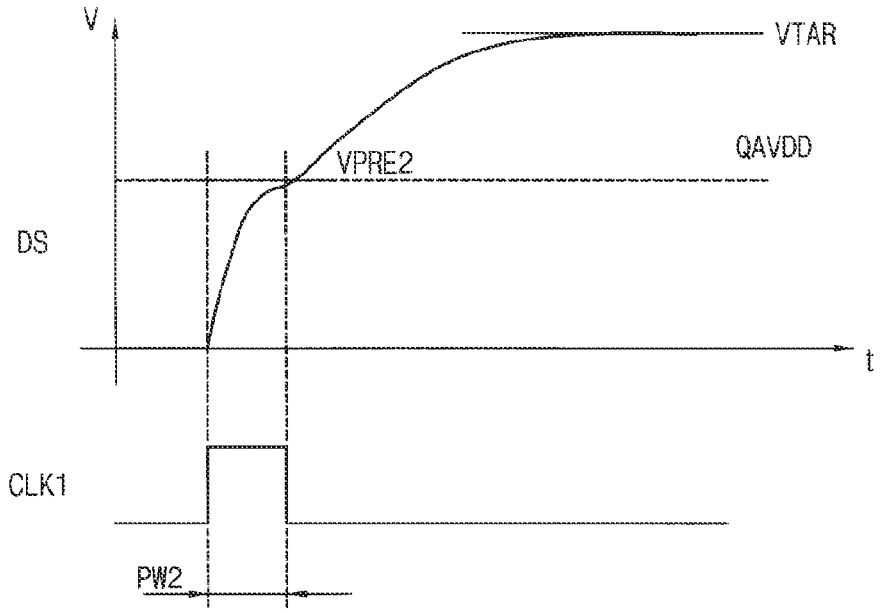

FIGS. 6A and 6B are timing diagrams illustrating the data signal DS applied to the data line DL according to the pulse width of the first clock signal CLK1 of FIG. 1.

Referring to FIGS. 1 to 6A, when the first clock signal CLK1 has a first pulse width PW1, the data line DL is charged with a first pre-charge voltage VPRE1 due to the analog voltage QAVDD during a first time period corresponding to the first pulse width PW1. The data line is charged with a target voltage VTAR in response to the deactivation of the first clock signal CLK1 after the first time period corresponding to the first pulse width PW1.

Referring to FIGS. 1 to 6B, when the first clock signal CLK1 has a second pulse width PW2 greater than the first pulse width PW1, the data line DL is charged with a second pre-charge voltage VPRE2 which is higher than the first pre-charge voltage VPRE1 due to the analog voltage QAVDD during a second time period corresponding to the second pulse width PW2. The data line is charged with the target voltage VTAR in response to the deactivation of the first clock signal CLK1 after the second time period corresponding to the second pulse width PW2.

The pulse width of the first clock signal CLK1 may be controlled by the timing controlling part 500. Specifically, the timing controlling part 500 may analyze the image pattern of the image data DATA and control the pulse width of the first clock signal CLK1 based on the analyzed image pattern. For example, the timing controlling part 500 may decrease the pulse width of the first clock signal CLK1 when the image pattern is the white image. The timing controlling part 500 may decrease the pulse width of the first clock signal CLK1 when the image pattern is the black image. The timing controlling part 500 may increase the pulse width of the first clock signal CLK1 when the image pattern is the stripe of black alternating with white.

Figure 7:
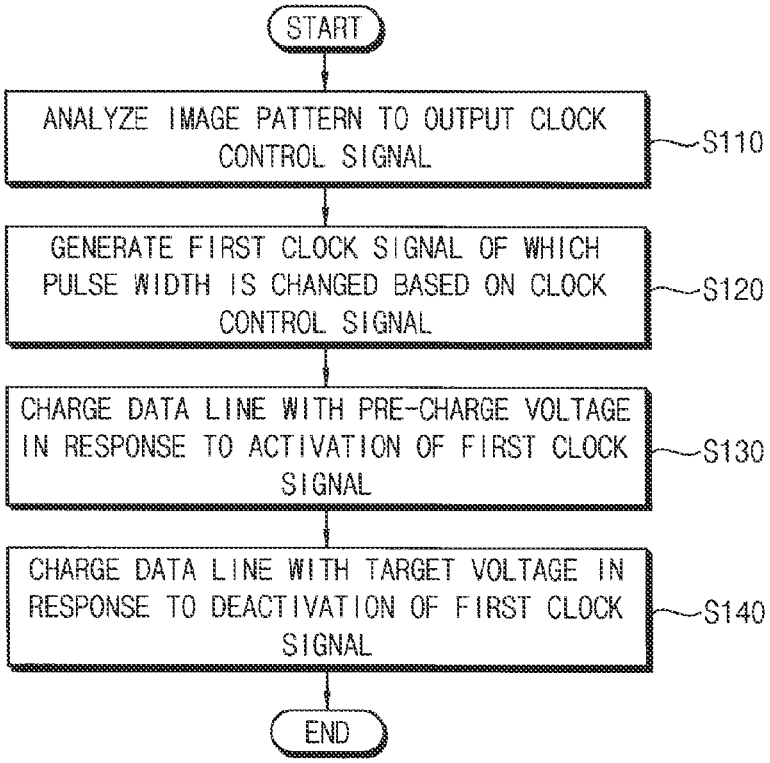
FIG. 7 is a flow chart illustrating a method of driving a display panel performed by a display panel driving apparatus of FIG. 1.

FIG. 7 is a flow chart illustrating a method of driving a display panel performed by the display panel driving apparatus of FIG. 1.

Referring to FIGS. 1 to 7, the image pattern is analyzed and the clock control signal CCS is outputted (step S110). Specifically, the image pattern analyzing part 521 of the timing controlling part 500 receives the image data DATA and analyzes the image pattern of the image data DATA to generate the clock control signal CCS controlling the pulse width of the first clock signal CLK1 according to the image pattern.

The first clock signal CLK1 including the pulse width which is changed based on the clock control signal CCS (step S120). Specifically, the first clock signal generating part 523 of the timing controlling part 500 generates the first clock signal CLK1 using the clock signal CLK received from the outside of the display panel and controls the pulse width of the first clock signal CLK1 according to the clock control signal CCS provided from the image pattern analyzing part 521.

The data line is charged with the pre-charge voltage in response to the activation of the first clock signal CLK1 (step S130). Specifically, the data line DL is charged with the pre-charge voltage by the analog voltage QAVDD during a time corresponding to the pulse width of the first clock signal CLK1.

The data line DL is charged with the target voltage VTAR in response to the deactivation of the first clock signal CLK1

(step S140). Specifically, the data line DL is charged with the target voltage VTAR in response to the deactivation of the first clock signal CLK1 after the time corresponding to the pulse width of the first clock signal CLK1.

According to the present exemplary embodiment, the image pattern of the image data DATA is analyzed, and the pulse width of the first clock signal CLK1 provided to the data driving part 300 is controlled according to the image pattern. Therefore, a charge sharing time of the data line DL may be controlled adaptively to the image pattern, the data signal DS may be charged to the data line DL adaptively to the image pattern, and thus power consumption and heating of the data driving part 300 may be decreased.

Figure 8:
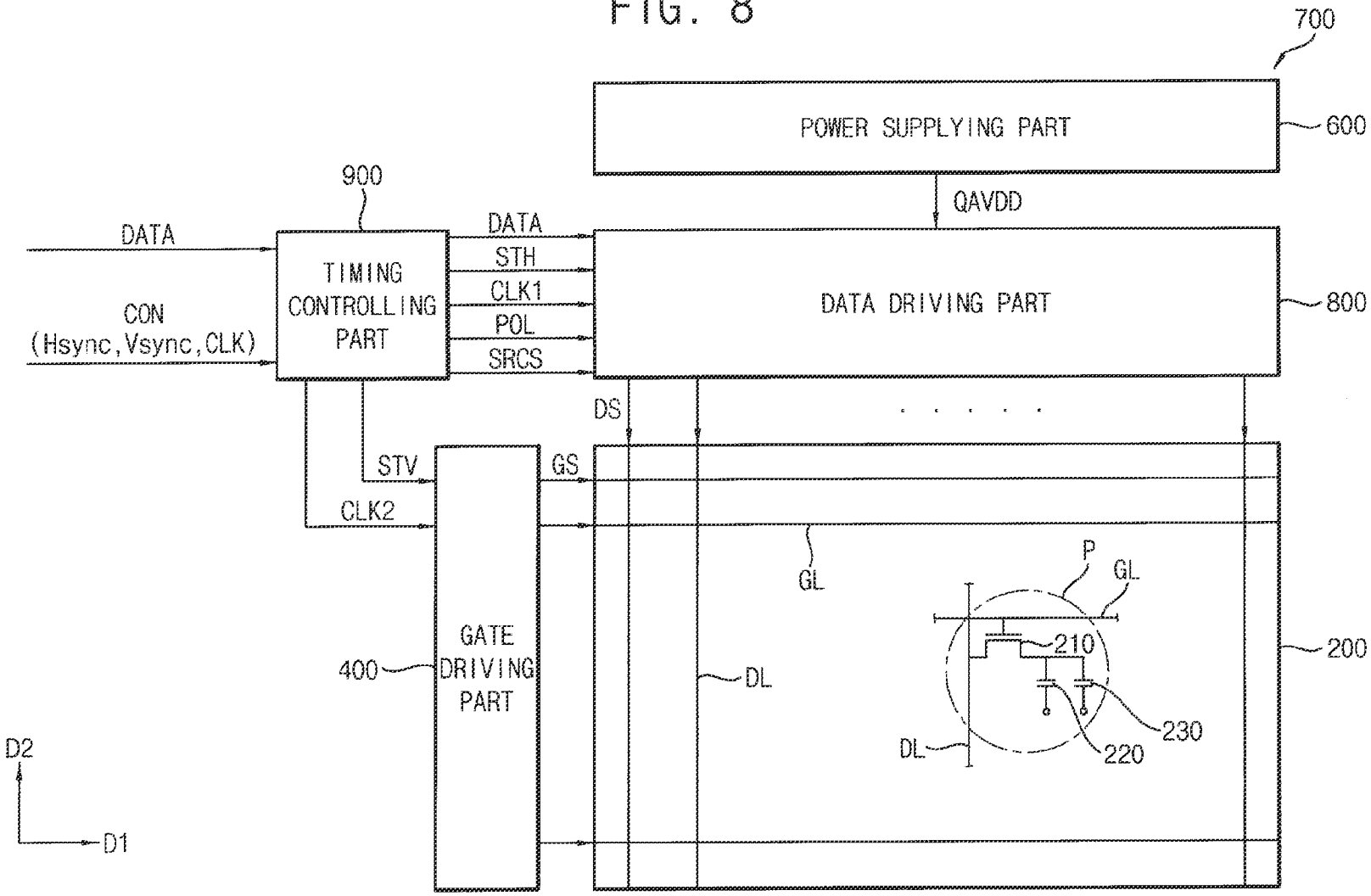
FIG. 8 is a block diagram illustrating a display apparatus according to another exemplary embodiment of the inventive concept.

FIG. 8 is a block diagram illustrating a display apparatus according to another exemplary embodiment of the inventive concept.

The display apparatus 700 according to the present exemplary embodiment is substantially the same as the display apparatus 100 according to the previous exemplary embodiment illustrated in FIG. 1 except for a data driving part 800 and a timing controlling part 900. Thus, the same reference numerals will be used to refer to same or like parts as those described in the previous example embodiment and any further repetitive explanation concerning the above elements will be omitted.

Referring to FIG. 8, the display apparatus 700 according to the present exemplary embodiment includes the display panel 200, the data driving part 800, the gate driving part 400, the timing controlling part 900 and the voltage generating part 600. The data driving part 800, the gate driving part 400 and the timing controlling part 900 may be a display panel driving apparatus driving the display panel 200.

The data driving part 800 outputs the data signal DS based on the image data DATA to the data line DL, in response to the data start signal STH and the first clock signal CLK1 provided from the timing controlling part 900.

The timing controlling part 900 receives the image data DATA and the control signal CON from the outside of the display panel. The control signal CON may include the horizontal synchronous signal Hsync, the vertical synchronous signal Vsync and the clock signal CLK. The timing controlling part 900 generates the data start signal STH using the horizontal synchronous signal Hsync and outputs the data start signal STH to the data driving part 800. In addition, the timing controlling part 900 generates the gate start signal STV using the vertical synchronous signal Vsync and outputs the gate start signal STV to the gate driving part 400. In addition, the timing controlling part 900 generates the first clock signal CLK1 and the second clock signal CLK2 using the clock signal CLK, outputs the first clock signal CLK1 to the data driving part 800 and outputs the second clock signal CLK2 to the gate driving part 400. In addition, the timing controlling part 900 may further output the polarity control signal POL controlling the polarity of the data signal DS outputted from the data driving part 800.

In addition, the timing controlling part 900 analyzes the image pattern of the image data DATA and controls the pulse width of the first clock signal CLK1 outputted to the data driving part 800 based on the image pattern, and outputs a slew rate control signal SRCS controlling a slew rate of the data signal DS.

Specifically, the timing controlling part 900 decreases the pulse width of the first clock signal CLK1 when the image pattern is the white image. In addition, the timing controlling part 900 decreases the pulse width of the first clock signal CLK1 when the image pattern is the black image. In addition, the timing controlling part 900 increases the pulse width of the first clock signal CLK1 when the image pattern is the stripe pattern of black alternating with the white. For example, the stripe pattern may be the horizontal stripe pattern of black alternating with the white. Alternatively, the stripe pattern may be the sub vertical stripe pattern of black alternating with the white.

In addition, the timing controlling part 900 may control the slew rate of the data signal DS after control the pulse width of the first clock signal CLK1 according to the image pattern. For example, the timing controlling part 900 may increase or decrease the slew rate of the data signal DS.

Figure 9:
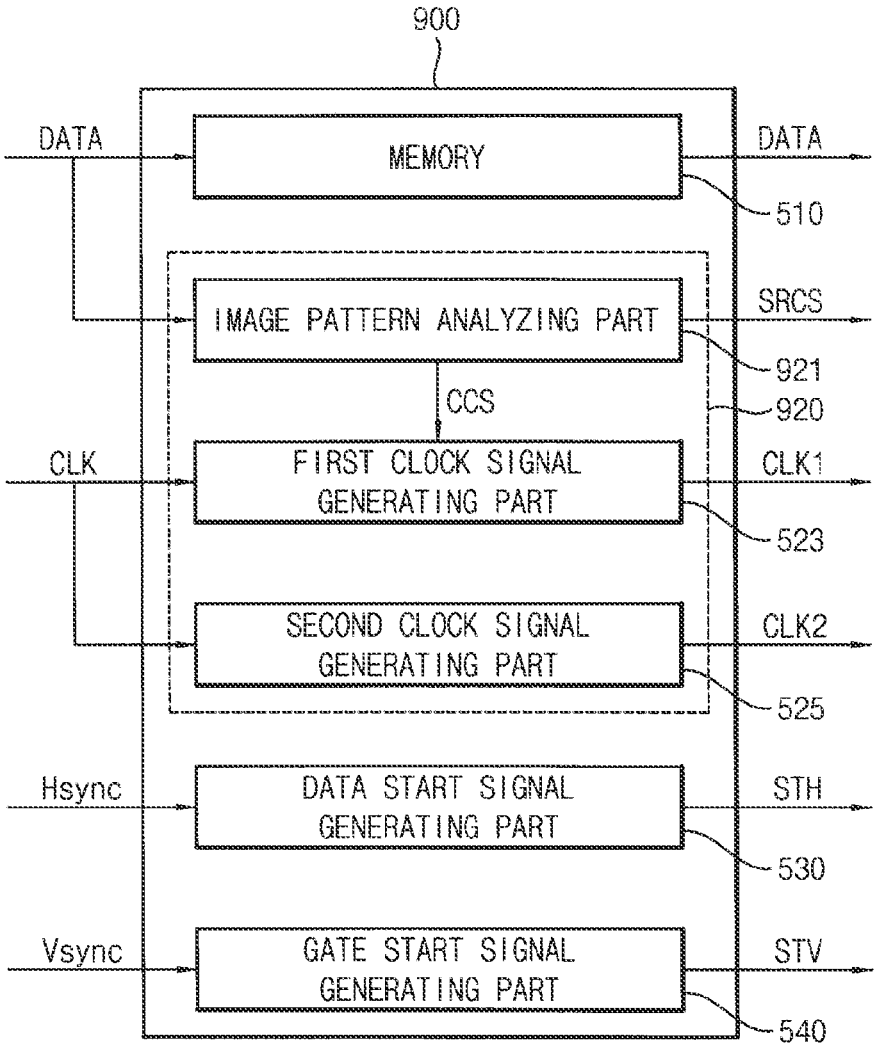
FIG. 9 is a block diagram illustrating a timing controlling part of FIG. 8.

FIG. 9 is a block diagram illustrating the timing controlling part 900 of FIG. 8.

The timing controlling part 900 according to the present exemplary embodiment is substantially the same as the timing controlling part 500 according to the previous exemplary embodiment illustrated in FIG. 2 except for a clock signal generating part 920. Thus, the same reference numerals will be used to refer to same or like parts as those described in the previous example embodiment and any further repetitive explanation concerning the above elements will be omitted.

Referring to FIGS. 8 and 9, the timing controlling part 900 includes the memory 510, the clock signal generating part 920, the data start signal generating part 530 and the gate start signal generating part 540.

The clock signal generating part 920 includes an image pattern analyzing part 921, the first clock signal generating part 523 and the second clock signal generating part 525.

The image pattern analyzing part 921 receives the image data DATA and analyzes the image pattern of the image data DATA to generate the clock control signal CCS controlling the pulse width of the first clock signal CLK1 according to the image pattern. In addition, the image pattern analyzing part 921 generates the slew rate control signal SRCS controlling the slew rate of the data signal DS according to the image pattern. For example, the image pattern may include at least one of the horizontal stripe pattern, the sub vertical stripe pattern, the vertical stripe pattern, the black pattern and the white pattern.

The first clock signal generating part 523 generates the first clock signal CLK1 using the clock signal CLK received from the outside and outputs the first clock signal CLK1 to the data driving part 800. The first clock signal generating part 523 controls the pulse width of the first clock signal CLK1 according to the clock control signal CCS provided from the image pattern analyzing part 921.

The second clock signal generating part 525 generates the second clock signal CLK2 using the clock signal received from the outside of the display panel and outputs the second clock signal CLK2 to the gate driving part 400.

Figure 10:
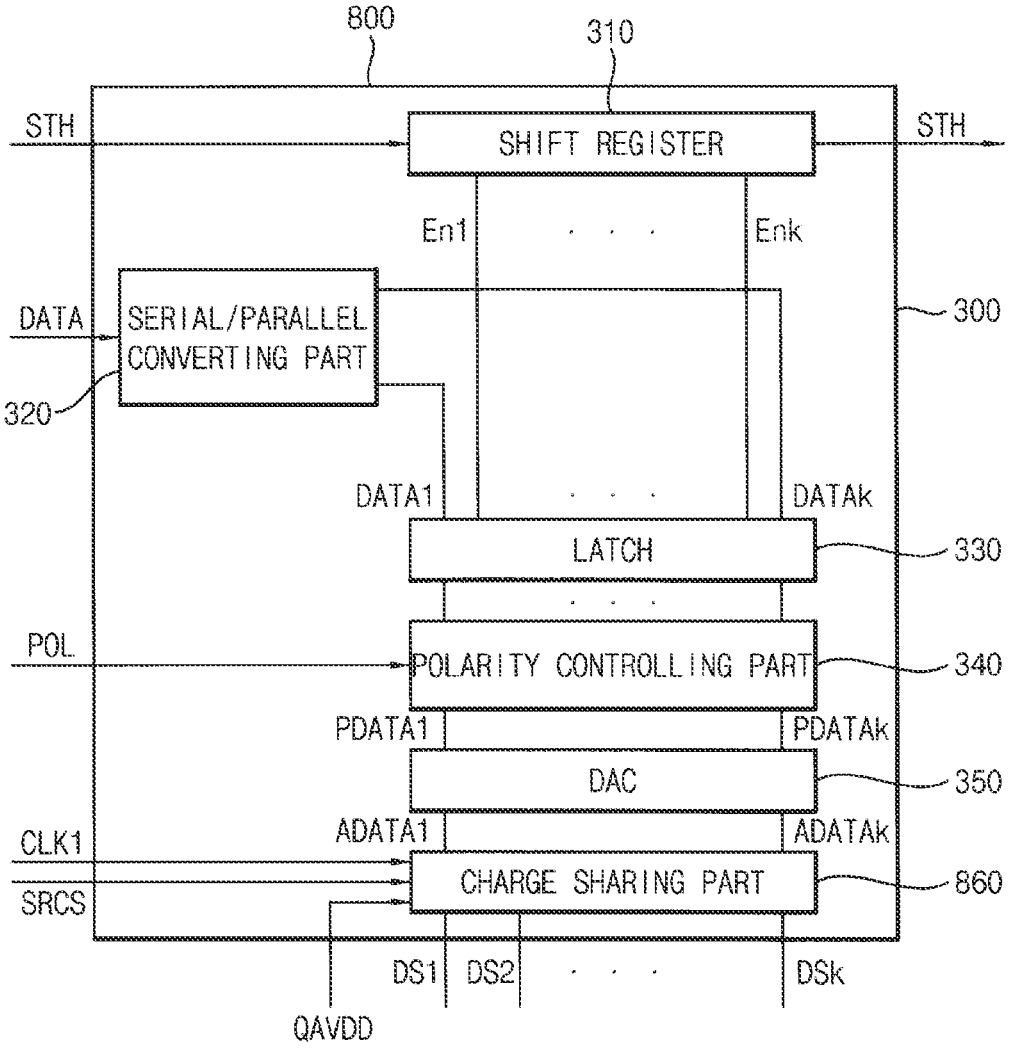
FIG. 10 is a block diagram illustrating a data driving part of FIG. 8.

FIG. 10 is a block diagram illustrating the data driving part 800 of FIG. 8.

The data driving part 800 according to the present exemplary embodiment is substantially the same as the data driving part 300 according to the previous exemplary embodiment illustrated in FIG. 3 except for a charge sharing part 860. Thus, the same reference numerals will be used to refer to same or like parts as those described in the previous example embodiment and any further repetitive explanation concerning the above elements will be omitted.

Referring to FIGS. 8 to 10, the data driving part 800 includes the shift register 310, the serial/parallel converting part 320, the latch 330, the polarity controlling part 340, the digital-analog converting part 350 and the charge sharing part 860.

The charge sharing part 860 applies the data signals DS1, DS2, . . . , DSk to the data lines DL using the analog data ADATA1, . . . , ADATAk according to the first clock signal CLK1 and the slew rate control signal SRCS provided from the timing controlling part 900.

Figure 11:
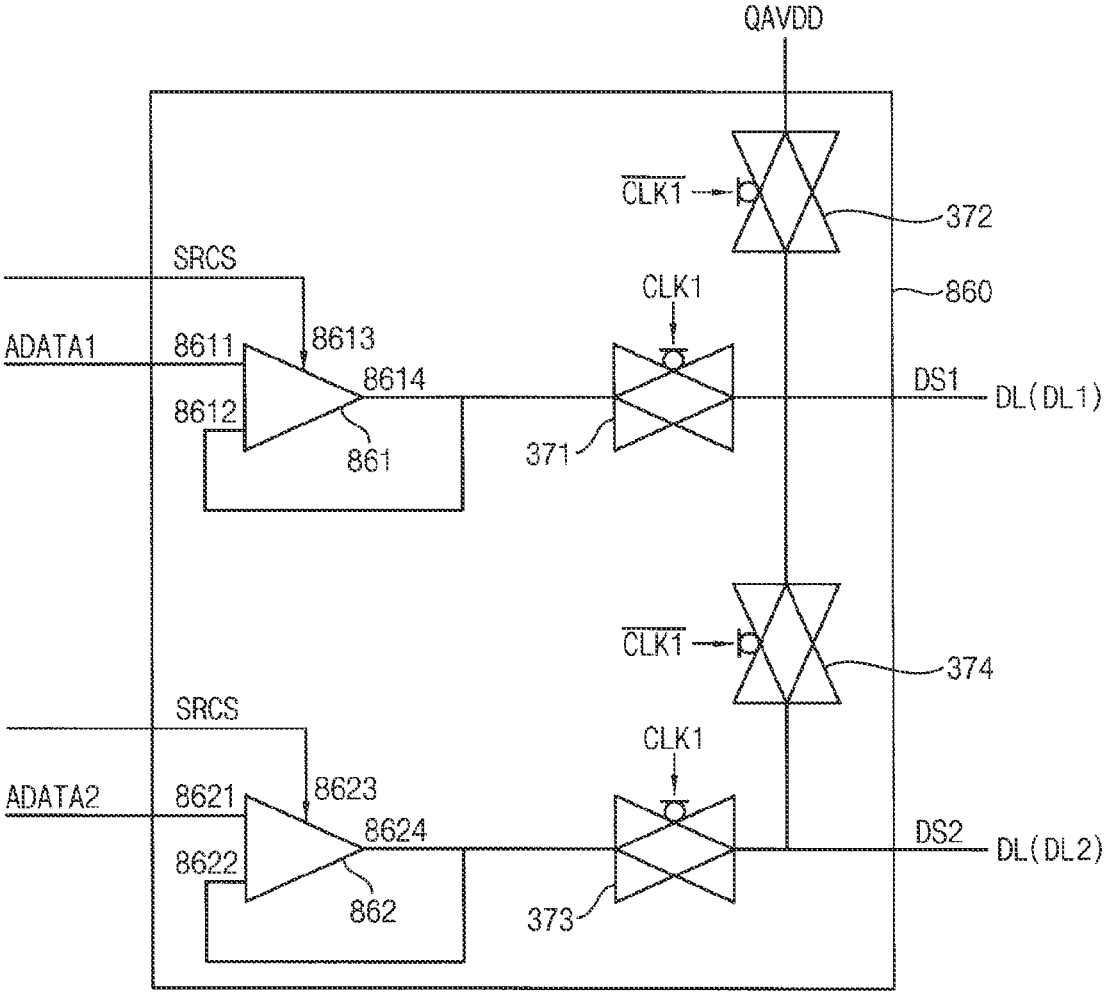
FIG. 11 is a block diagram illustrating a charge sharing part of FIG. 10.

FIG. 11 is a block diagram illustrating the charge sharing part 860 of FIG. 10.

The charge sharing part 860 according to the present exemplary embodiment is substantially the same as the charge sharing part 360 according to the previous exemplary embodiment illustrated in FIG. 4 except for a first amplifier 861 and a second amplifier 862. Thus, the same reference numerals will be used to refer to same or like parts as those described in the previous example embodiment and any further repetitive explanation concerning the above elements will be omitted.

Referring to, FIGS. 8 to 11, the charge sharing part 860 includes the first amplifier 861, the second amplifier 862, the first switch 371, the second switch 372, the third switch 373 and the fourth switch 374.

The first amplifier 861 includes a first input terminal 8611, a second input terminal 8612, a third input terminal 8613 and an output terminal 8614. The first input terminal 8611 of the first amplifier 861 receives the first analog data ADATA1 outputted from the digital-analog converting part 350. The second input terminal 8612 of the first amplifier 861 selectively receives the analog voltage QAVDD through the second switch 372. The third input terminal 8613 of the first amplifier 861 receives the slew rate control signal SRCS. The output terminal 8614 of the first amplifier 861 is connected to the second input terminal 8612 and is connected to the data line DL of the display panel 200 through the first switch 371.

The second amplifier 862 includes a first input terminal 8621, a second input terminal 8622, a third input terminal 8623 and an output terminal 8624. The first input terminal 8621 of the second amplifier 862 receives the second analog data ADATA2 outputted from the digital-analog converting part 350. The second input terminal 8622 of the second amplifier 862 selectively receives the analog voltage QAVDD through the fourth switch 374. The third input terminal 8623 of the second amplifier 862 receives the slew rate control signal SRCS. The output terminal 8624 of the second amplifier 862 is connected to the second input terminal 8622 and is connected to the data line DL of the display panel 200 through the third switch 373.

Each of the first amplifier 861 and the second amplifier 862 controls the slew rate of the data signal DS applied to the data line DL according to the slew rate control signal SRCS. For example, the first amplifier 861 may control a slew rate of the first data signal DS1 applied to the first data line DL1 of the data line DL according to the slew rate control signal SRCS, and the second amplifier 862 may control a slew rate of the second data signal DS2 applied to the second data line DL2 of the data line DL according to the slew rate control signal SRCS.

Figure 12:
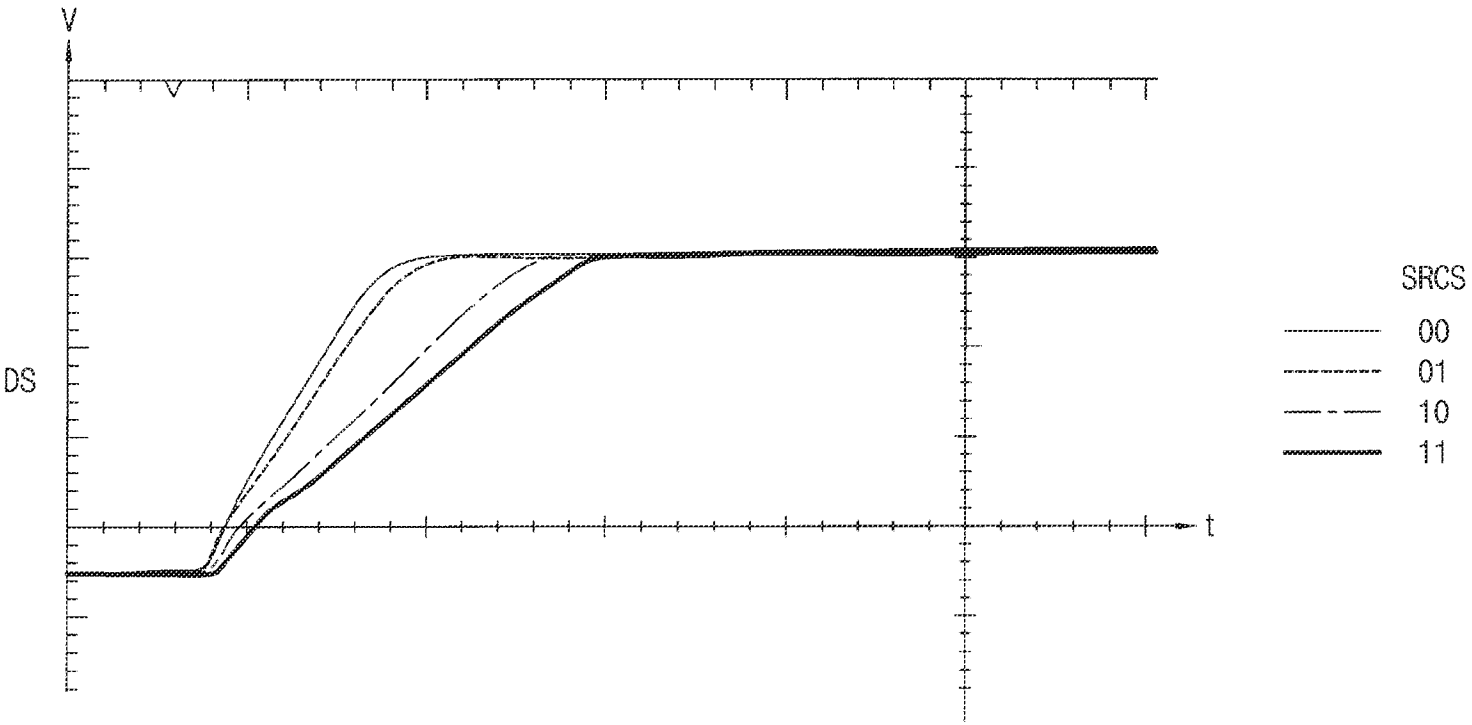
FIG. 12 is a timing diagram illustrating a data signal according to a slew rate control signal of FIG. 8.

FIG. 12 is a timing diagram illustrating the data signal DS according to the slew rate control signal SRCS of FIG. 8.

Referring to FIG. 12, the slew rate of the data signal DS may be controlled according to the slew rate control signal SRCS. Specifically, the slew rate of the data signal DS may be a first value when the slew rate control signal SRCS is '00', the slew rate of the data signal DS may be a second value less than the first value when the slew rate control signal SRCS is '01', the slew rate of the data signal DS may be a third value less than the second value when the slew rate control signal SRCS is '10', and the slew rate of the data signal DS may be a fourth value less than the third value when the slew rate control signal SRCS is '11'.

For example, a slew rate time of the data signal DS according to the slew rate control signal SRCS may be the same as [Table 1]

TABLE 1

| | SRCS | | | |
|---|---|---|---|---|
| | 00 | 01 | 10 | 11 |
| slew rate time | 0.8 μs | 1.2 μs | 1.6 μs | 2.0 μs |

The slew rate time may be a time from a time point when the data signal DS is start to be increased in response to the first clock signal CLK1 to a time point when the data signal DS is reached to about 90% of the target voltage. For example, the slew rate time of the data signal DS may be about 0.8 μs when the slew rate control signal is '00', the slew rate time of the data signal DS may be about 1.2 μs when the slew rate control signal is '01', the slew rate time of the data signal DS may be about 1.6 μs when the slew rate control signal is '10', and the slew rate time of the data signal DS may be about 2.0 μs when the slew rate control signal is '11'.

Figure 13:
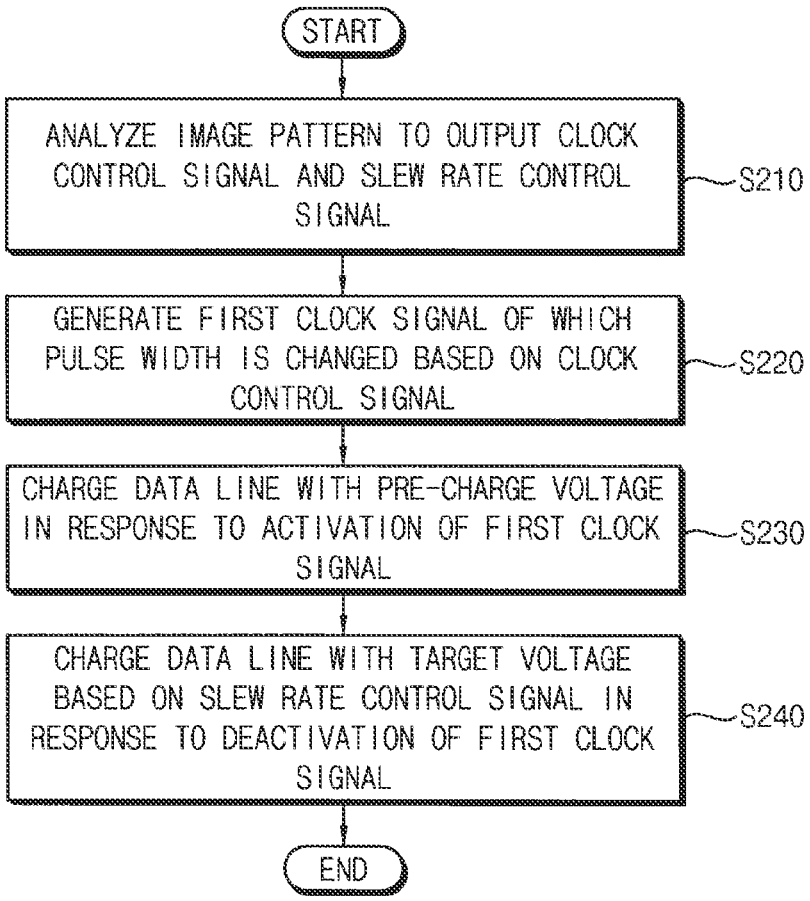
FIG. 13 is a flow chart illustrating a method of driving a display panel performed by a display panel driving apparatus of FIG. 8.

FIG. 13 is a flow chart illustrating a method of driving a display panel performed by the display panel driving apparatus of FIG. 8.

Referring to FIGS. 8 to 13, the image pattern is analyzed and the clock control signal CCS and the slew rate control signal SRCS are outputted (step S210). Specifically, the image pattern analyzing part 921 of the timing controlling part 900 receives the image data DATA and analyzes the image pattern of the image data DATA to generate the clock control signal CCS controlling the pulse width of the first clock signal CLK1 according to the image pattern and the slew rate control signal SRCS controlling the slew rate of the data signal DS.

The first clock signal CLK1 including the pulse width which is changed based on the clock control signal CCS (step S220). Specifically, the first clock signal generating part 923 of the timing controlling part 900 generates the first clock signal CLK1 using the clock signal CLK received from the outside of the display panel and controls the pulse width of the first clock signal CLK1 according to the clock control signal CCS provided from the image pattern analyzing part 921.

The data line is charged with the pre-charge voltage in response to the activation of the first clock signal CLK1 (step S230). Specifically, the data line DL is charged with the pre-charge voltage by the analog voltage QAVDD during the time corresponding to the pulse width of the first clock signal CLK1.

The data line DL is charged with the target voltage VTAR in response to the deactivation of the first clock signal CLK1 (step S240). Specifically, the data line DL is charged with the target voltage VTAR in response to the deactivation of the first clock signal CLK1 after the time corresponding to the pulse width of the first clock signal CLK1, and the slew rate of the data signal DS is applied to the data line DL based on the slew rate control signal SRCS.

Figure 14A:
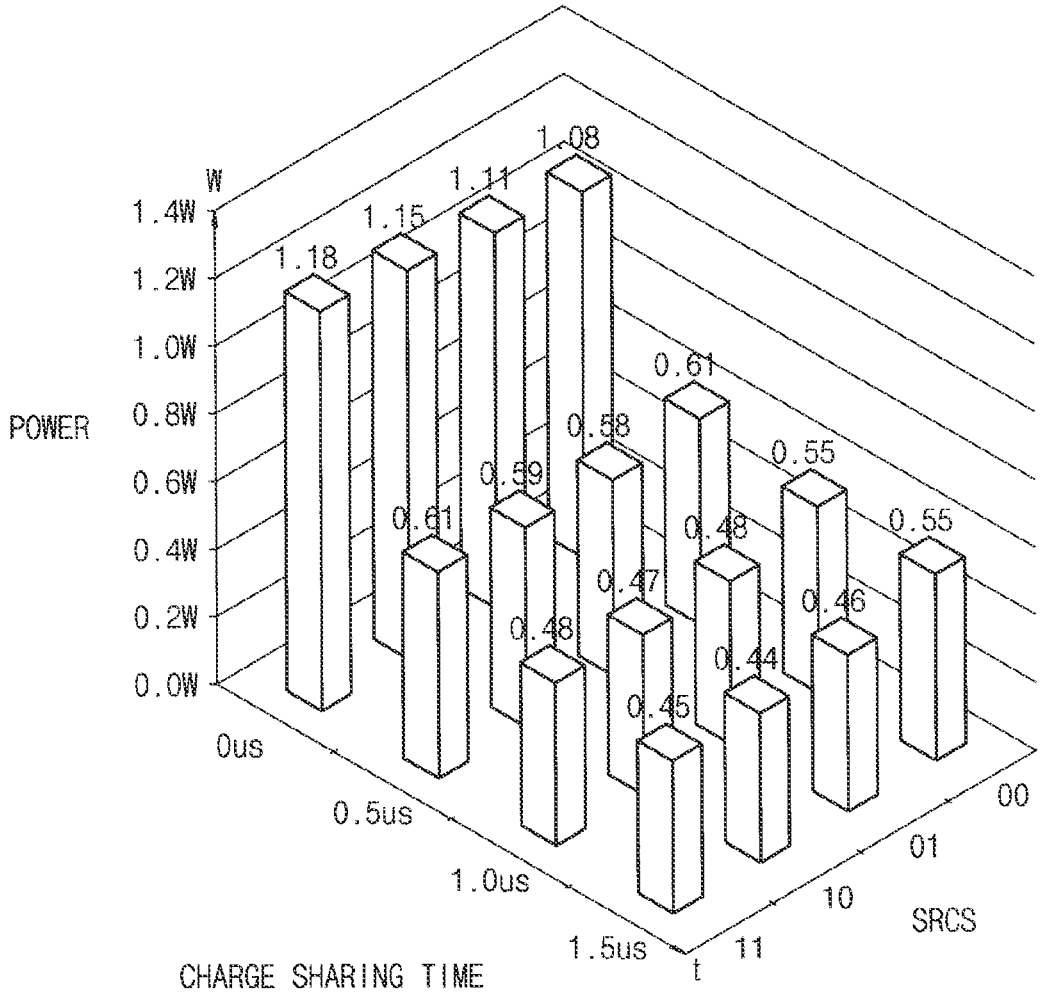
FIGS. 14A and 14B are graphs illustrating power consumption of a data driving part in FIG. 8 according to an image pattern.
Figure 14B:
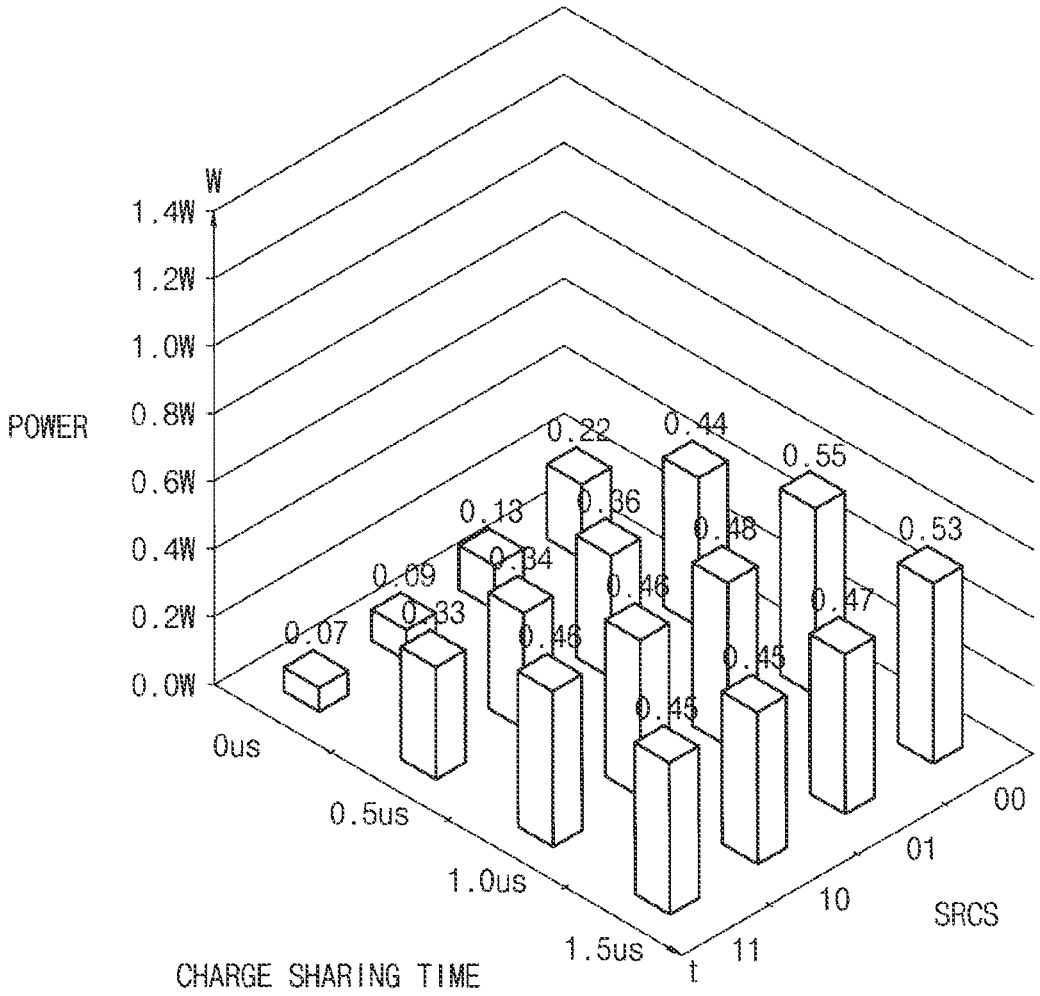

FIGS. 14A and 14B are graphs illustrating power consumption of the data driving part 800 in FIG. 8 according to the image pattern.

Referring to FIGS. 8 to 14A, when the image pattern is the horizontal stripe pattern, power consumption of the data driving part 800 is decreased as a charge sharing time according to the pulse width of the first clock signal CLK1 is increased. Thus, when the image pattern is the horizontal stripe pattern, the pulse width of the first clock signal CLK1 may be increased to decrease the power consumption and generation of heat of the data driving part 800. For example, when the image pattern is the horizontal stripe pattern, the pulse width of the first clock signal CLK1 may be about 1.5 μs.

In addition, when the image pattern is the horizontal stripe pattern, power consumption of the data driving part 800 may be different according to the slew rate control signal SRCS which controls slew rate time. Specifically, when the pulse width of the first clock signal CLK1 is comparatively great, power consumption of the data driving part 800 may be generally decreased as the slew rate time is increased. Thus, power consumption of the data driving part 800 may be further decreased as the slew rate time of the data signal DS is increased. Therefore, when the image pattern is the horizontal stripe pattern and the pulse width of the first clock signal CLK1 is comparatively great, heating of the data driving part 800 may be decreased as the slew rate time is increased.

Referring to FIGS. 8 to 13 and 14B, when the image pattern is the white pattern, power consumption of the data driving part 800 is decreased as the charge sharing time according to the pulse width of the first clock signal CLK1 is decreased. Thus, when the image pattern is the white pattern, the pulse width of the first clock signal CLK1 may be decreased to decrease the power consumption and generation of heat of the data driving part 800. For example, when the image pattern is the white pattern, the pulse width of the first clock signal CLK1 may be about 0 μs.

In addition, when the image pattern is the white pattern, power consumption of the data driving part 800 may be different according to the slew rate control signal SRCS. Specifically, when the pulse width of the first clock signal CLK1 is comparatively less, power consumption of the data driving part 800 may be generally decreased as the slew rate time is increased. Thus, power consumption of the data driving part 800 may be decreased as the slew rate time is increased. Therefore, when the image pattern is the white pattern and the pulse width of the first clock signal CLK1 is comparatively less, heating of the data driving part 800 may be decreased as the slew rate time is increased.

According to the present exemplary embodiment, the image pattern of the image data DATA is analyzed, and the pulse width of the first clock signal CLK1 provided to the data driving part 800 is controlled according to the image pattern. In addition, the slew rate of the data signal DS is controlled according to the image pattern. Therefore, a charge sharing time of the data line DL may be controlled adaptively to the image pattern, the data signal DS may be charged adaptively to the image pattern, and thus power consumption and heating of the data driving part 800 may be decreased.

Figure 15:
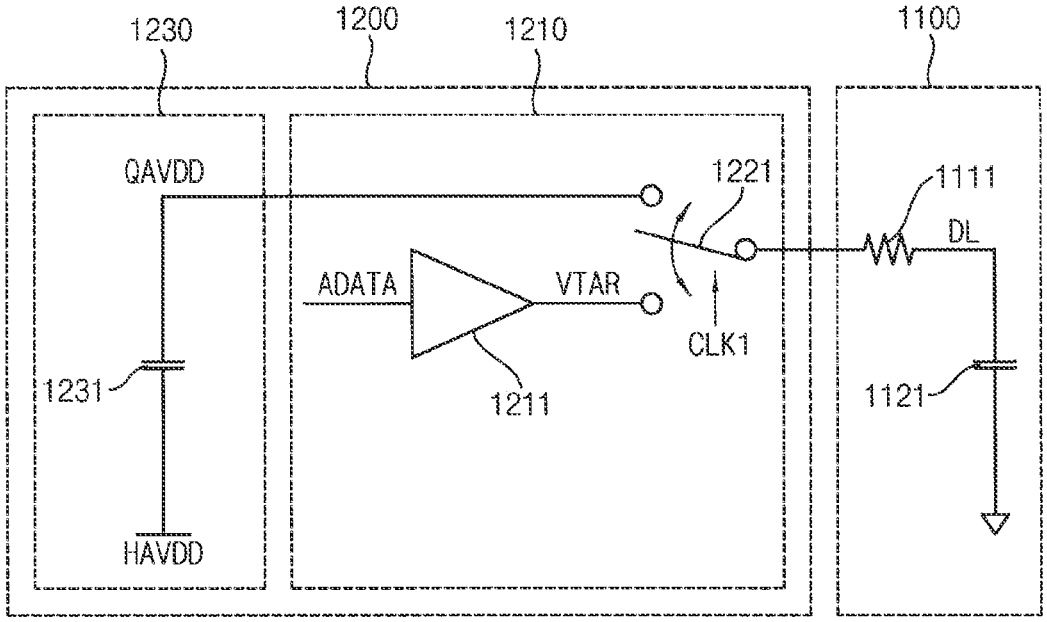
FIG. 15 is a circuit diagram illustrating a display panel and a data driving part according to still another exemplary embodiment of the inventive concept.

FIG. 15 is a circuit diagram illustrating a display panel and a data voltage generating circuit according to still another exemplary embodiment of the inventive concept.

The display panel 1100 and the data voltage generating circuit 1200 according to the present exemplary embodiment may be used in the display apparatus 100 according to the previous exemplary embodiment illustrated in FIG. 1. A display apparatus including the display panel 1100 and the data voltage generating circuit 1200 according to the present exemplary embodiment is substantially the same as the display apparatus 100 according to the previous exemplary embodiment illustrated in FIG. 1 except for the data voltage generating circuit 1200. Thus, the same reference numerals will be used to refer to same or like parts as those described in the previous example embodiment and any further repetitive explanation concerning the above elements will be omitted.

Referring to FIG. 15, the display panel 1100 may be substantially the same as the display panel 200 of FIG. 1, and the display panel 1100 includes a panel load resistor 1111 and a panel load capacitor 1121. The panel load resistor 1111 and the panel load capacitor 1121 may be formed in the data line DL.

The data voltage generating circuit 1200 includes a charge sharing part 1210 and an analog voltage generating part.

The charge sharing part 1210 includes an amplifier 1211 and a switch 1221.

The amplifier 1211 receives an analog data ADATA and outputs a target voltage VTAR. The switch 1221 selectively connects an output terminal of the amplifier 1211 and a charge sharing capacitor 1231 which is in the analog voltage generating part 1230 and charged with a first analog voltage QAVDD to the data line DL. The switch 1221 may selectively connects the amplifier 1211 and the charge sharing capacitor 1231 to the data line DL in response to the first clock signal CLK1 illustrated in FIG. 1.

The analog voltage generating part 1230 includes the charge sharing capacitor 1231. The charge sharing capacitor 1231 includes a first end selectively connected to the data line DL through the switch 1221 and a second end connected to a second analog voltage HAVDD. The second analog voltage HAVDD may be a half of the first analog voltage QAVDD, and the second analog voltage HAVDD may be provided from the power supplying part 600 of FIG. 1.

Figure 16:
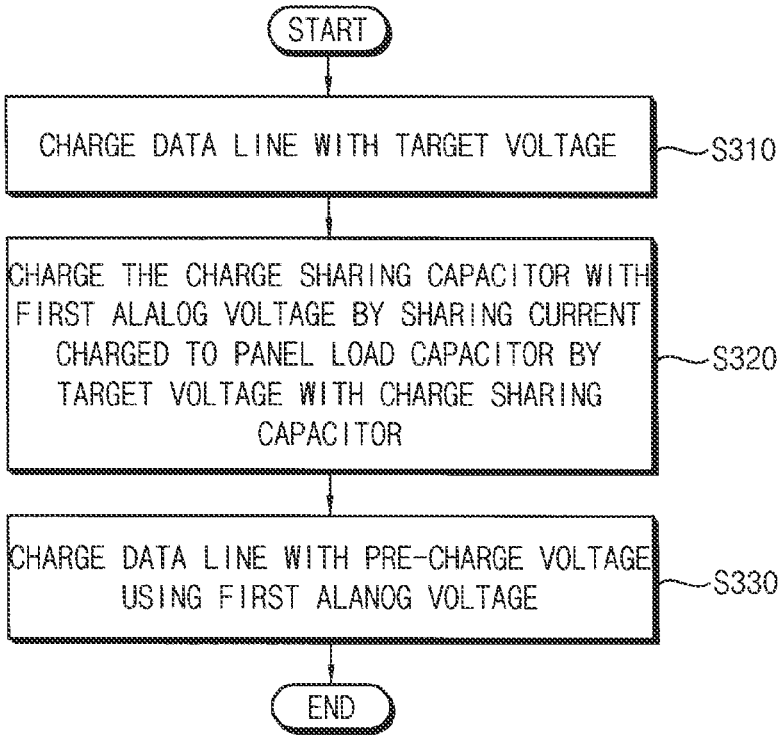
FIG. 16 is a flow chart illustrating a method of driving a display panel performed by a display panel driving apparatus including the data driving part of FIG. 15.

FIG. 16 is a flow chart illustrating a method of driving a display panel performed by a display panel driving apparatus including the data voltage generating circuit 1200 of FIG. 15.

Referring to FIGS. 15 and 16, the data line DL is charged with the target voltage VTAR (step S310). Specifically, the data line DL is charged with the target voltage VTAR in response to the deactivation of the first clock signal CLK1.

A current charged to the panel load capacitor 1211 by the target voltage VTAR is shared with the charge sharing capacitor 1231 to charge the charge sharing capacitor 1231 with the first analog voltage QAVDD (step S320). Here, the first analog voltage QAVDD may be different according to the target voltage VTAR charged to the data line DL. In addition, the step of sharing the current charged to the panel load capacitor 1211 with the charge sharing capacitor 1231 may be repeated several times to charge the charge sharing capacitor 1231 with the first analog voltage QAVDD.

The data line DL is charged with a pre-charge voltage using the first analog voltage QAVDD (step S330). Specifically, the data line DL is charged with the pre-charge voltage by the first analog voltage QAVDD during a time corresponding to the pulse width of the first clock signal CLK1 in response to the activation of the first clock signal CLK1. The pulse width of the first clock signal CLK1 may be different according to the image pattern, and the pulse width of the first clock signal CLK1 may be controlled by the image pattern analyzing part 521 of the timing controlling part 500 in FIG. 2.

Step S310, step S320 and step S330 of FIG. 16 may be used in step S130 which is the step of charging the pre-charge voltage to the data line DL in response to the activation of the first clock signal CLK1 in FIG. 7. In addition, step S310, step S320 and step S330 of FIG. 16 may be used in step S230 which is the step of charging the pre-charge voltage to the data line DL in response to the activation of the first clock signal CLK1 in FIG. 13.

According to the present exemplary embodiment, the analog voltage generating part 1230 in the data voltage generating circuit 1200 includes only the charge sharing capacitor 1231, therefore structure of the analog voltage generating part 1230 may be simplified and manufacturing cost of the data voltage generating circuit 1200 and the display apparatus including the analog voltage generating part 1230 may be decreased.

Figure 17:
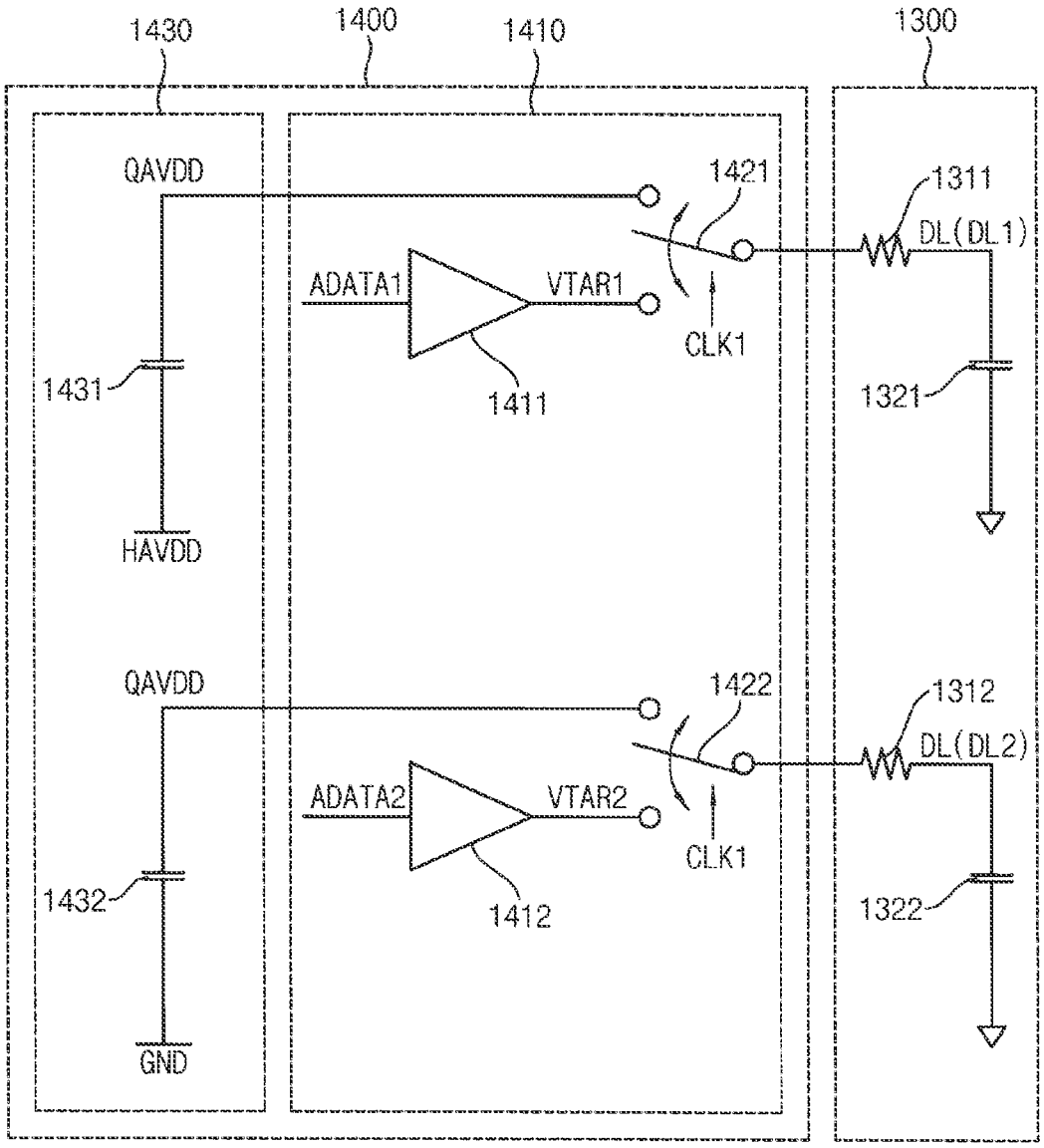
FIG. 17 is a circuit diagram illustrating a display panel and a data driving part according to still another exemplary embodiment of the inventive concept.

FIG. 17 is a circuit diagram illustrating a display panel and a data voltage generating circuit according to still another exemplary embodiment of the inventive concept.

The display panel 1300 and the data voltage generating circuit 1400 according to the present exemplary embodiment may be in the display apparatus 100 according to the previous exemplary embodiment illustrated in FIG. 1, and a display apparatus including the display panel 1300 and the data voltage generating circuit 1400 according to the present exemplary embodiment is substantially the same as the display apparatus 100 according to the previous exemplary embodiment illustrated in FIG. 1 except for the data voltage generating circuit 1400. Thus, the same reference numerals will be used to refer to same or like parts as those described in the previous example embodiment and any further repetitive explanation concerning the above elements will be omitted.

Referring to FIG. 17, the display panel 1300 may be substantially the same as the display panel 200 of FIG. 1, and the display panel 1300 includes a first panel load resistor 1311, a first load capacitor 1321, a second panel load resistor 1312 and a second panel load capacitor 1322. The first panel load resistor 1311 and the first panel load capacitor 1321 may be formed in a first data line DL1 of the data line DL, and the second panel load resistor 1312 and the second panel load capacitor 1322 may be formed in a second data line DL2 of the data line DL.

The data voltage generating circuit 1400 includes a charge sharing part 1410 and an analog voltage generating part 1430.

The charge sharing part 1410 includes a first amplifier 1411 and a first switch 1421, a second amplifier 1412 and a second switch 1422.

The first amplifier 1411 receives a first analog data ADATA1 and outputs a first target voltage VTAR1. The first switch 1421 selectively connects an output terminal of the first amplifier 1411 and a first charge sharing capacitor 1431 which is in the analog voltage generating part 1430 and charged with a first analog voltage QAVDD to the first data line DL1. The first switch 1421 may selectively connects the first amplifier 1411 and the first charge sharing capacitor 1431 to the first data line DL1 in response to the first clock signal CLK1 illustrated in FIG. 1.

The second amplifier 1412 receives a second analog data ADATA2 and outputs a second target voltage VTAR2. The second switch 1422 selectively connects an output terminal of the second amplifier 1412 and a second charge sharing capacitor 1432 which is in the analog voltage generating part 1430 and charged with the first analog voltage QAVDD to the second data line DL2. The second switch 1422 may selectively connects the second amplifier 1412 and the second charge sharing capacitor 1432 to the second data line DL2 in response to the first clock signal CLK1 illustrated in FIG. 1.

The analog voltage generating part 1430 includes the first charge sharing capacitor 1431 and the second charge sharing capacitor 1432. A first data signal outputted from the first data line DL1 may swing between the first analog voltage QAVDD and a second analog voltage. Therefore, the first charge sharing capacitor 1431 includes a first end receiving the first analog voltage QAVDD and selectively connected to the first data line DL1 by the first switch 1421, and a second end connected to a terminal to which the second analog voltage HAVDD is applied. The second analog voltage HAVDD may be a half of the first analog voltage QAVDD. A second data signal outputted from the second data line DL2 may swing between the first analog voltage QAVDD and a ground voltage GND. Therefore, the second charge sharing capacitor 1432 includes a first end receiving the first analog voltage QAVDD and selectively connected to the second data line DL2 by the second switch 1422, and a second end connected to a terminal to which the ground voltage GND is applied.

A method of driving a display panel performed by a display panel driving apparatus including the data voltage generating circuit 1400 of FIG. 17 is substantially the same as the method of driving a display panel of FIG. 16.

Specifically, the first data line DL1 is charged with the first target voltage VTAR1 and the second data line DL2 is charged with the second target voltage VTAR2 in response to the deactivation of the first clock signal CLK1.

A current charged to the first panel load capacitor 1321 by the first target voltage VTAR1 is shared with the first charge sharing capacitor 1431 to charge the first charge sharing capacitor 1431 with the first analog voltage QAVDD. The first data line DL1 is charged with a first pre-charge voltage during a time corresponding to the pulse width of the first clock signal CLK1 using the first analog voltage QAVDD charged to the first charge sharing capacitor 1431, in response to the activation of the first clock signal CLK1.

In addition, a current charged to the second panel load capacitor 1322 by the second target voltage VTAR2 is shared with the second charge sharing capacitor 1432 to charge the second charge sharing capacitor 1432 with the first analog voltage QAVDD. The second data line DL2 is charged with a second pre-charge voltage during the time corresponding to the pulse width of the first clock signal CLK1 using the first analog voltage QAVDD charged to the second charge sharing capacitor 1432, in response to the activation of the first clock signal CLK1.

The pulse width of the first clock signal CLK1 may be different according to the image pattern, and the pulse width of the first clock signal CLK1 may be controlled by the image pattern analyzing part 521 of the timing controlling part 500 in FIG. 2.

According to the present exemplary embodiment, the analog voltage generating part 1430 in the data voltage generating circuit 1400 includes only the charge sharing capacitors 1431 and 1432, therefore structure of the analog voltage generating part 1430 may be simplified and manufacturing cost of the data voltage generating circuit 1400 and the display apparatus including the analog voltage generating part 1430 may be decreased.

Figure 18:
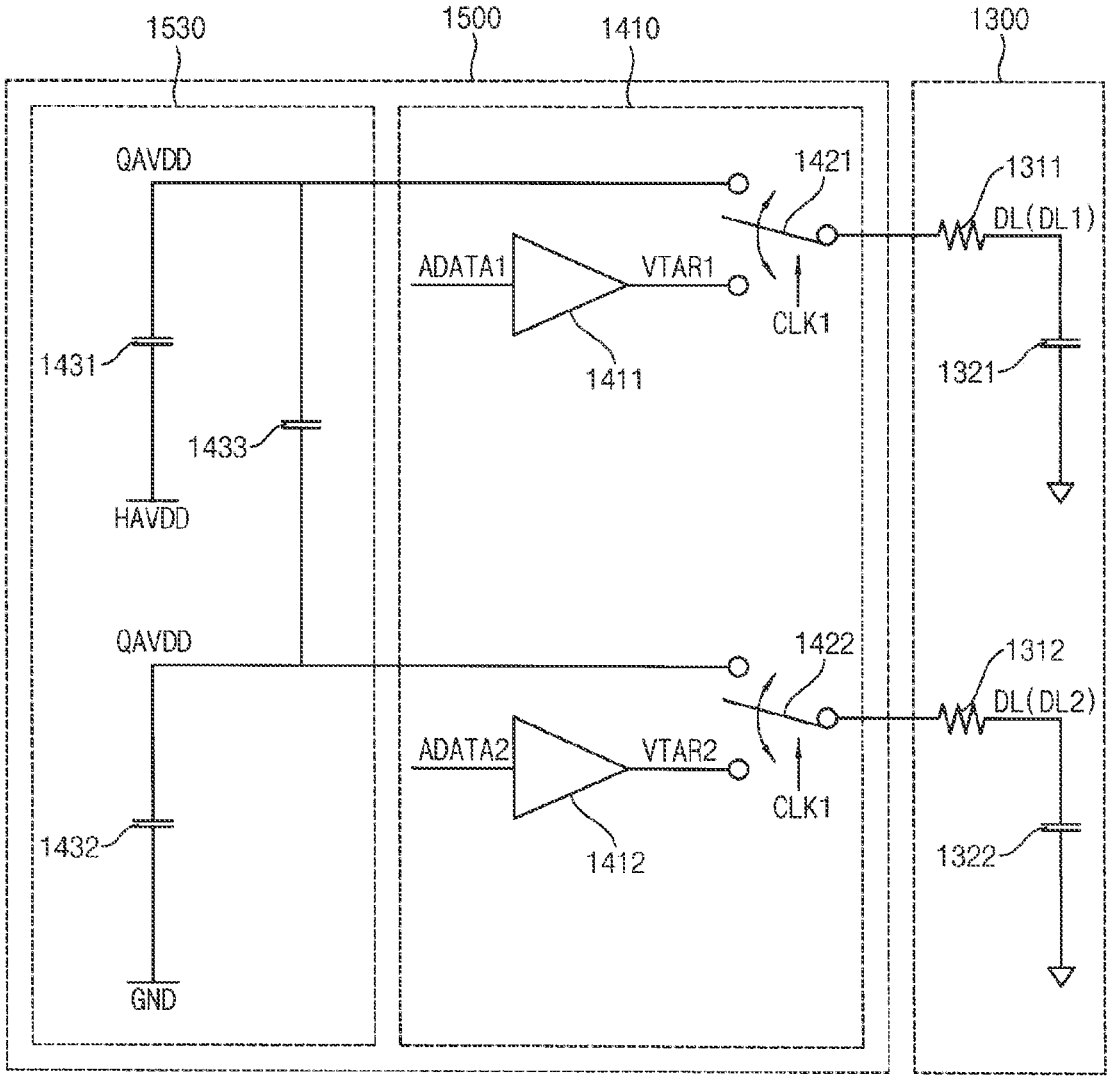
FIG. 18 is a circuit diagram illustrating a display panel and a data driving part according to still another exemplary embodiment of the inventive concept.

FIG. 18 is a circuit diagram illustrating a display panel and a data voltage generating part according to still another exemplary embodiment of the inventive concept.

The display panel 1300 and the data voltage generating part 1500 according to the present exemplary embodiment may be in the display apparatus 100 according to the previous exemplary embodiment illustrated in FIG. 1, and a display apparatus including the display panel 1300 and the data voltage generating part 1500 according to the present exemplary embodiment is substantially the same as the display apparatus 100 according to the previous exemplary embodiment illustrated in FIG. 1 except for the data voltage generating part 1500. In addition, the display panel 1300 according to the present exemplary embodiment is substantially the same as the display panel 1300 according to the previous exemplary embodiment illustrated in FIG. 17. In addition, a charge sharing part 1410 in the data voltage generating part 1500 according to the present exemplary embodiment is substantially the same as the charge sharing part 1410 in the data voltage generating circuit 1400 according to the previous exemplary embodiment illustrated in FIG. 17. Thus, the same reference numerals will be used to refer to same or like parts as those described in the previous example embodiment and any further repetitive explanation concerning the above elements will be omitted.

Referring to FIG. 18, the data voltage generating part 1500 includes the charge sharing part 1410 and an analog voltage generating part 1530.

The analog voltage generating part 1530 includes the first charge sharing capacitor 1431, the second charge sharing capacitor 1432 and a third charge sharing capacitor 1433. The first charge sharing capacitor 1431 includes the first end selectively connected to the first data line DL1 through the first switch 1421 and the second end connected to the terminal to which the second analog voltage HAVDD is applied. The second charge sharing capacitor 1432 includes the first end selectively connected to the second data line DL2 through the second switch 1422 and the second end connected to the terminal to which the ground voltage GND is applied. The third charge sharing capacitor 1433 includes a first end connected to the first end of the first charge sharing capacitor 1431 and a second end connected to the first end of the second charge sharing capacitor 1432.

A method of driving a display panel performed by a display panel driving apparatus including the data voltage generating part 1500 of FIG. 18 is substantially the same as the method of driving a display panel of FIG. 16.

Specifically, the first data line DL1 is charged with the first target voltage VTAR1 and the second data line DL2 is charged with the second target voltage VTAR2 in response to the deactivation of the first clock signal CLK1.

The current charged to the first panel load capacitor 1321 by the first target voltage VTAR1 is shared with the first charge sharing capacitor 1431 and the third charge sharing capacitor 1433 to charge the first charge sharing capacitor 1431 and the third charge sharing capacitor with the first analog voltage QAVDD. The first data line DL1 is charged with the first pre-charge voltage during the time corresponding to the pulse width of the first clock signal CLK1 using the first analog voltage QAVDD charged to the first charge sharing capacitor 1431 and the third charge sharing capacitor 1433, in response to the activation of the first clock signal CLK1.

In addition, the current charged to the second panel load capacitor 1322 by the second target voltage VTAR2 is shared with the second charge sharing capacitor 1432 and the third charge sharing capacitor 1433 to charge the second charge sharing capacitor 1432 and the third charge sharing capacitor 1433 with the first analog voltage QAVDD. The second data line DL2 is charged with the second pre-charge voltage during the time corresponding to the pulse width of the first clock signal CLK1 using the first analog voltage QAVDD charged to the second charge sharing capacitor 1432 and the third charge sharing capacitor 1433, in response to the activation of the first clock signal CLK1.

According to the present exemplary embodiment, the analog voltage generating part 1530 in the data voltage generating part 1500 includes only the charge sharing capacitors 1431, 1432 and 1433, therefore structure of the analog voltage generating part 1530 may be simplified and manufacturing cost of the data voltage generating part 1500 and the display apparatus including the analog voltage generating part 1530 may be decreased.

Figure 19:
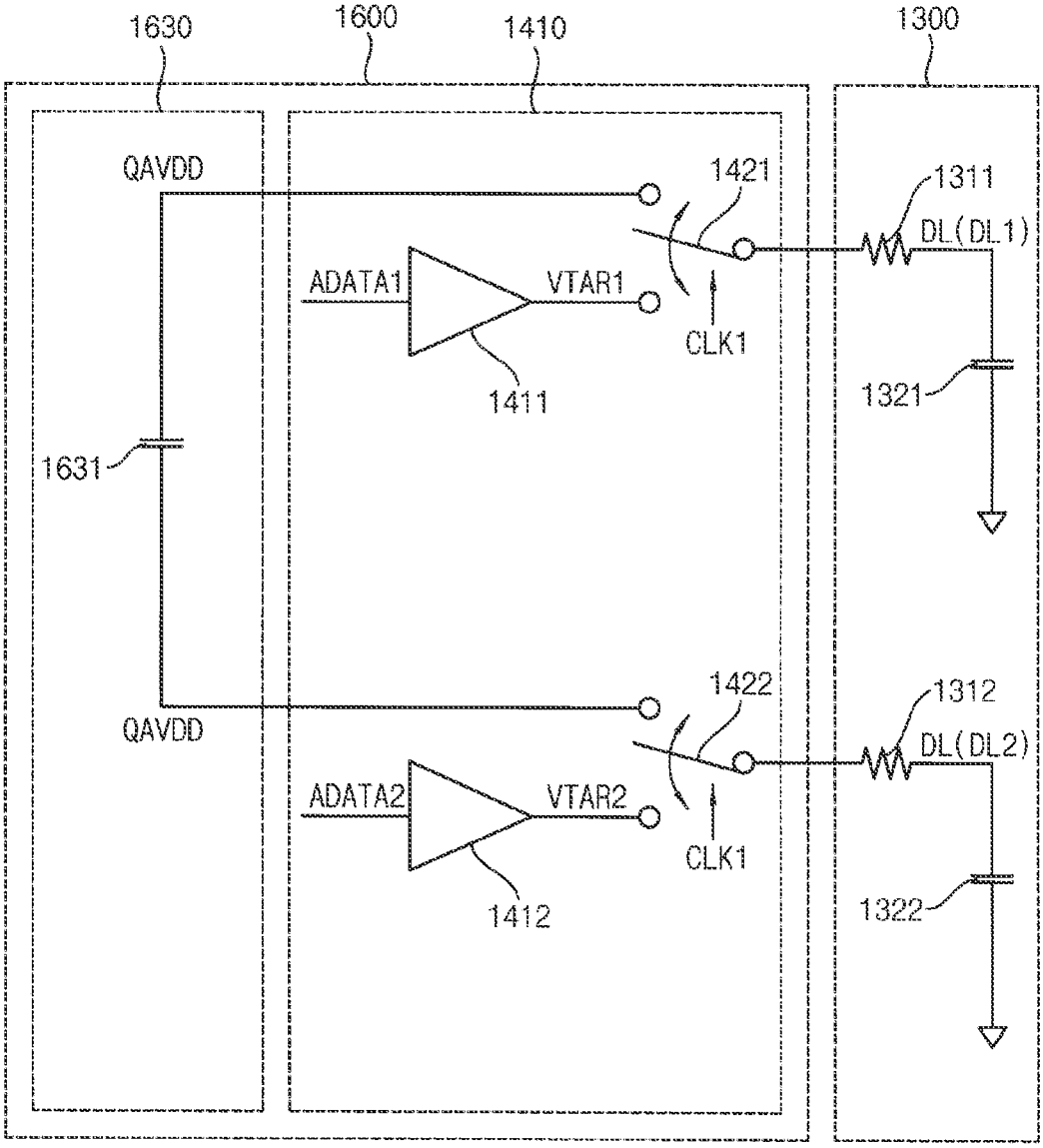
FIG. 19 is a circuit diagram illustrating a display panel and a data driving part according to still another exemplary embodiment of the inventive concept.

FIG. 19 is a circuit diagram illustrating a display panel and a data voltage generating circuit according to still another exemplary embodiment of the inventive concept.

The display panel 1300 and the data voltage generating circuit 1600 according to the present exemplary embodiment may be in the display apparatus 100 according to the previous exemplary embodiment illustrated in FIG. 1, and a display apparatus including the display panel 1300 and the data voltage generating circuit 1600 according to the present exemplary embodiment is substantially the same as the display apparatus 100 according to the previous exemplary embodiment illustrated in FIG. 1 except for the data voltage generating circuit 1600. In addition, the display panel 1300 according to the present exemplary embodiment is substantially the same as the display panel 1300 according to the previous exemplary embodiment illustrated in FIG. 17. In addition, a charge sharing part 1410 in the data voltage generating circuit 1600 according to the present exemplary embodiment is substantially the same as the charge sharing part 1410 in the data voltage generating circuit 1400 according to the previous exemplary embodiment illustrated in FIG. 17. Thus, the same reference numerals will be used to refer to same or like parts as those described in the previous example embodiment and any further repetitive explanation concerning the above elements will be omitted.

Referring to FIG. 19, the data voltage generating circuit 1600 includes the charge sharing part 1410 and an analog voltage generating part 1630.

The analog voltage generating part 1630 includes a charge sharing capacitor 1631. The charge sharing capacitor 1631 includes a first end selectively connected to the first data line DL1 by the first switch 1421 and a second end selectively connected to the second data line DL2 by the second switch 1422.

A method of driving a display panel performed by a display panel driving apparatus including the data voltage generating circuit 1600 of FIG. 19 is substantially the same as the method of driving a display panel of FIG. 16.

Specifically, the first data line DL1 is charged with the first target voltage VTAR1 and the second data line DL2 is charged with the second target voltage VTAR2 in response to the deactivation of the first clock signal CLK1.

The current charged to the first panel load capacitor 1321 by the first target voltage VTAR1 is shared with the charge sharing capacitor 1631 to charge the charge sharing capacitor 1631 with the first analog voltage QAVDD. The first data line DL1 is charged with the first pre-charge voltage during the time corresponding to the pulse width of the first clock signal CLK1 using the first analog voltage QAVDD charged to the charge sharing capacitor 1631, in response to the activation of the first clock signal CLK1.

In addition, the current charged to the second panel load capacitor 1322 by the second target voltage VTAR2 is shared with the charge sharing capacitor 1631 to charge the charge sharing capacitor 1631 with the first analog voltage QAVDD. The second data line DL2 is charged with the second pre-charge voltage during the time corresponding to the pulse width of the first clock signal CLK1 using the first analog voltage QAVDD charged to the charge sharing capacitor 1631, in response to the activation of the first clock signal CLK1.

According to the present exemplary embodiment, the analog voltage generating part 1630 in the data voltage generating circuit 1600 includes only the charge sharing capacitor 1631, therefore structure of the analog voltage generating part 1630 may be simplified and manufacturing cost of the data voltage generating circuit 1600 and the display apparatus including the analog voltage generating part 1630 may be decreased.

According to the method of driving a display panel, the display panel driving apparatus performing the method and display apparatus having the display panel driving apparatus, an image pattern of an image data is analyzed, and a pulse width of a clock signal provided to a data driving part is controlled according to the image pattern. Therefore, a charge sharing time of a data line may be controlled adaptively to the image pattern, a data signal may be charged to the data line adaptively to the image pattern, and thus power consumption and generation of heat of the data driving part may be decreased.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A method of driving a display panel, comprising: analyzing an image pattern of an image data;

Generating a clock signal having a different pulse width according to the image pattern of an image data, the clock signal controlling a pre-charge time of a data line; and outputting the clock signal to a data driving part, wherein the clock signal has a first clock signal having a first pulse width and a second clock signal having a second pulse width wider than the first pulse width, and wherein the first pulse width and the second pulse width are greater than zero, and wherein the generating a clock signal having different pulse width comprises:

generating a first pulse width of the clock signal when the image pattern is a black image or a white image; and generating a second pulse width greater than the first pulse width of the clock signal when the image pattern is a stripe pattern of black alternating with white.

2. The method of claim 1, further comprising: pre-charging a pre-charge voltage to the data line in response to an activation of the clock signal.

3. The method of claim 2, wherein the pre-charge voltage is charged to the data line during a first time period corresponding to the first pulse width when the clock signal has the first pulse width, and the pre-charge voltage is charged to the data line during a second time period corresponding to the second pulse width when the clock signal has the second pulse width greater than the first pulse width.

4. The method of claim 2, wherein a first pre-charge voltage is charged to the data line when the clock signal has the a-first pulse width, and a second pre-charge voltage greater than the first pre-charge voltage is charged to the data line when the clock signal has the a-second pulse width greater than the first pulse width.

5. The method of claim 2, further comprising: charging the data line with a target voltage in response to a deactivation of the clock signal.

6. The method of claim 5, wherein the pre-charging a pre-charge voltage to the data line comprises:

charging the data line with the target voltage;

sharing a current charged to a load capacitor of the display panel by the target voltage with a charge sharing capacitor to charge the charge sharing capacitor with an analog voltage; and charging the data line with the pre-charge voltage using the analog voltage.

7. The method of claim 1, further comprising:

generating a slew rate control signal controlling a slew rate of a data signal applied to the data line.

8. The method of claim 7, wherein the slew rate includes a first slew rate when the image pattern is the black image or the white image and a second slew rate which is smaller than the first slew rate when the image pattern is the stripe pattern of a black alternating with white.

9. A display panel driving apparatus comprising:

an image pattern analyzing part configured to analyze an image pattern of an image data to output a clock control signal;

a clock signal generating part configured to generate a clock signal having a different pulse width according to the image pattern of an image data, the clock signal controlling a pre-charge time of a data line: and a data driving part receiving the clock signal and configured to drive the data line of a display panel in response to the clock signal, wherein the clock signal has a first clock signal having a first pulse width and a second clock signal having a second pulse width wider than the first pulse width, wherein the first pulse width and the second pulse width are greater than zero, and wherein the clock signal generating part generates generating a first pulse width of the clock signal when the image pattern is a black image or a white image and generates generating a second pulse width of the clock signal greater than the first pulse width of the clock signal when the image pattern is a stripe pattern of black alternating with white.

10. The display panel driving apparatus of claim 9, wherein the data driving part pre-charges a pre-charge voltage to the data line in response to an activation of the clock signal.

11. The display panel driving apparatus of claim 10, wherein the pre-charge voltage is charged to the data line during a first time period corresponding to the first pulse width when the clock signal has the first pulse width, and the pre-charge voltage is charged to the data line during a second time period corresponding to the second pulse width when the clock signal has the second pulse width.

12. The display panel driving apparatus of claim 10, wherein the data driving part charges the data line with a target voltage in response to a deactivation of the clock signal.

13. The display panel driving apparatus of claim 12, further comprising: an analog voltage generating part configured to pre-charge the data line with the pre-charge voltage; and a charge sharing part configured to charge the data line with the target voltage, wherein the analog voltage generating part comprises a charge sharing capacitor which shares a current charged to a load capacitor of the display panel, and the charge sharing part comprises an amplifier which outputs the target voltage and a switch which selectively connects the amplifier and the charge sharing capacitor with the data line.

14. The display panel driving apparatus of claim 13, wherein the analog voltage generating part includes a first charge sharing capacitor selectively connected to a first data line of the data line and a second charge sharing capacitor selectively connected to a second data line of the data line, and the charge sharing part includes a first amplifier which outputs a first target voltage to the first data line, a second amplifier which outputs a second target voltage to the second data line, a first switch which selectively connects the first amplifier and the first charge sharing capacitor with the first data line, and a second switch which selectively connects the second amplifier and the second charge sharing capacitor with the second data line.

15. The display panel driving apparatus of claim 14, wherein the analog voltage generating part further comprises a third charge sharing capacitor connected to the first charge sharing capacitor and the second charge sharing capacitor.

16. The display panel driving apparatus of claim 13, wherein the charge sharing capacitor is selectively connected to a first data line of the data line.

17. The display panel driving apparatus of claim 9, wherein the image pattern analyzing part further generates generating a slew rate control signal controlling a slew rate of a data signal applied to the data line.

18. A display apparatus comprising: a display panel configured to receive a data signal based on an image data; and a display panel driving apparatus comprising an image pattern analyzing part configured to analyze an image pattern of the image data to output a clock control signal, a clock signal generating part configured to control a pulse width of a clock signal in response to the clock control signal to output the clock signal the clock signal controlling a precharge time of a data line, and a data driving part receiving the clock signal and configured to drive the data line of the display panel in response to the clock signal, wherein the clock signal has a first clock signal having a first pulse width and a second clock signal having a second pulse width wider than the first pulse width, wherein the first pulse width and the second pulse width are greater than zero, and wherein the clock signal generating part generates generating a first pulse width of the clock signal when the image pattern is a black image or a white image and generates generating a second pulse width of the clock signal greater than the first pulse width of the clock signal when the image pattern is a stripe pattern of black alternating with white.

* * * * *